US009706292B2

(12) United States Patent
Duraiswami et al.

(10) Patent No.: US 9,706,292 B2
(45) Date of Patent: Jul. 11, 2017

(54) AUDIO CAMERA USING MICROPHONE ARRAYS FOR REAL TIME CAPTURE OF AUDIO IMAGES AND METHOD FOR JOINTLY PROCESSING THE AUDIO IMAGES WITH VIDEO IMAGES

(75) Inventors: Ramani Duraiswami, Highland, MD (US); Adam O'Donovan, Bethesda, MD (US); Nail A. Gumerov, Elkridge, MD (US)

(73) Assignee: University of Maryland, Office of Technology Commercialization, College Park, MD (US)

( * ) Notice: Subject to any disclaimer, the term of this patent is extended or adjusted under 35 U.S.C. 154(b) by 658 days.

(21) Appl. No.: 13/556,099

(22) Filed: Jul. 23, 2012

(65) Prior Publication Data

US 2012/0288114 A1 Nov. 15, 2012

Related U.S. Application Data

(63) Continuation of application No. 12/127,451, filed on May 27, 2008, now Pat. No. 8,229,134.

(60) Provisional application No. 60/939,891, filed on May 24, 2007.

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2201/401* (2013.01); *H04R 2430/20* (2013.01)

(58) Field of Classification Search
CPC .... H04R 25/407; H04R 3/005; H04R 25/552; H04R 1/406; H04R 2201/401; H04R 2430/20; H04R 25/405; H04R 2225/41; H04R 2225/43; H04R 2225/021; H04R 2499/11; H04R 25/453; H04R 1/403
USPC ..... 381/17, 18, 24–26, 92, 309; 700/94
See application file for complete search history.

(56) References Cited

U.S. PATENT DOCUMENTS

| | | | | |
|---|---|---|---|---|
| 5,173,944 | A * | 12/1992 | Begault | 381/17 |
| 7,587,054 | B2 * | 9/2009 | Elko et al. | 381/92 |
| 8,229,134 | B2 * | 7/2012 | Duraiswami et al. | 381/92 |
| 2004/0091119 | A1 * | 5/2004 | Duraiswami et al. | 381/26 |
| 2006/0262939 | A1 * | 11/2006 | Buchner | H04S 5/005 381/56 |

OTHER PUBLICATIONS

Daniel et al., "Further Investigation of High Order Ambisonics and Wavefield Synthesis for Holophonic Sound Imaging," Proceedings at the 114th Convention Audio Engineering Society, preprint #5788 (2003).

(Continued)

*Primary Examiner* — Lun-See Lao

(57) ABSTRACT

A method comprises providing at least one processing unit comprising a decomposing section and a playback section; receiving, at the decomposing section, audio data generated via an array of microphones, the audio data representing an acoustic scene; decomposing the audio data into a plurality of signals representing components of the acoustic scene arriving from a plurality of directions, using the decomposing section; and rendering the audio components for a listener based on the plurality of directions of the audio components, using the playback section.

18 Claims, 12 Drawing Sheets

(56) References Cited

OTHER PUBLICATIONS

Duda et al., "Range Dependence of the Response of a Spherical Head Model," Journal of the Acoustical Society of America, 104(5):3048-3058 (1998).
Duraiswami et al., "Plane-Wave Decomposition Analysis for the Spherical Microphone Arrays," Proceedings IEEE Workshop on Applications of Signal Processing to Audio and Acoustics, 150-153 (2005).
Hartmann, "How We Localize Sound," Physics Today, 52(11):24-29 (1999).
Li et al., Headphone-Based Reproduction of 3D Auditory Scenes Captured by Spherical/Hemispherical Microphone Arrays, Proceedings of IEEE International Conference on Acoustics, Speech and Signal Processing, 5:337-340 (2006).
Teutsch et al., "An Integrated Real-Time System for Immersive Audio Applications," Proceedings of the IEEE Workshop on Applications of Signal Processing to Audio and Acoustics, 67-70 (2003).
Triggs et al., "Bundle Adjustment—A Modern Synthesis," Vision Algorithms: Theory and Practice, LNCS:1883, Springer-Verlag, 298-373 (1999).
Wenzel et al., "Localization Using Non-Individualized Head-Related Transfer Functions," Journal of the Acoustical Society of America, 94(1):111-123 (1993).
Zotkin et al., "Fast Head-Related Transfer Function Measurement Via Reciprocity," Journal of the Acoustical Society of America, 120(4):2202-2215.
Zotkin et al., "Rendering Localized Spatial Audio in a Virtual Auditory Space," IEEE Transactions on Multimedia, 6(4):553-564 (2004).

* cited by examiner

AUDIO CAMERA USING MICROPHONE ARRAYS FOR REAL TIME CAPTURE OF AUDIO IMAGES AND METHOD FOR JOINTLY PROCESSING THE AUDIO IMAGES WITH VIDEO IMAGES

PRIORITY

The present application is a continuation of U.S. patent application Ser. No. 12/127,451, filed on May 27, 2008. The entire contents of that application, as well as U.S. Provisional Patent Application Ser. No. 60/939,891 and the references cited therein, are incorporated by reference in their entireties. The following published references relate to the present application. The entire contents of these references are incorporated herein by reference: Adam O'Donovan, Ramani Duraiswarni, and Jan Neumann, Microphone Arrays as Generalized Cameras for Integrated Audio Visual Processing, Jun. 21, 2007, Proceedings IEEE CVPR; Adam O'Donovan, Ramani Duraiswami, Nail A. Gumerov, Real Time Capture of Audio Images and Their Use with Video, Oct. 22, 2007, Proceedings IEEE WASPAA; Adam O'Donovan, Ramani Duraiswami, Dmitry N. Zotkin, Imaging Concert Hall Acoustics Using Visual and Audio Cameras, April 2008, Proceedings IEEE ICASSP 2008; and Adam O'Donovan, Dmitry N. Zotkin, Ramani Duraiswami, Spherical Microphone Array Based Immersive Audio Scene Rendering, Jun. 24-27, 2008, Proceedings of the 14$^{th}$ International Conference on Auditory Display.

BACKGROUND

Over the past few years there have been several publications that deal with the use of spherical microphone arrays. Such arrays are seen by some researchers as a means to capture a representation of the sound field in the vicinity of the array, and by others as a means to digitally beamform sound from different directions using the array with a relatively high order beampattern, or for nearby sources. Variations to the usual solid spherical arrays have been suggested, including hemispherical arrays, open arrays, concentric arrays and others.

A particularly exciting use of these arrays is to steer it to various directions and create an intensity map of the acoustic power in various frequency bands via beamforming. The resulting image, since it is linked with direction can be used to identify source location (direction), be related with physical objects in the world and identify sources of sound, and be used in several applications. This brings up the exciting possibility of creating a "sound camera."

To be useful, two difficulties must be overcome. The first, is that the beamforming requires the weighted sum of the Fourier coefficients of all the microphone signals, and multichannel sound capture, and it has been difficult to achieve frame-rate performance, as would be desirable in applications such as videoconferencing, noise detection, etc. Second, while qualitative identification of sound sources with real-world objects (speaking humans, noisy machines, gunshots) can be done via a human observer who has knowledge of the environment geometry, for precision and automation the sound images must be captured in conjunction with video, and the two must be automatically analyzed to determine correspondence and identification of the sound sources. For this a formulation for the geometrically correct warping of the two images, taken from an array and cameras at different locations is necessary.

SUMMARY

Due to the recognition that spherical array derived sound images satisfy central projection, a property crucial to geometric analysis of multi-camera systems, it is possible to calibrate a spherical-camera array system, and perform vision-guided beamforming. Therefore, in accordance with the present disclosure, the spherical-camera array system, which can be calibrated as it has been shown, is extented to achieve frame-rate sound image creation, beamforming, and the processing of the sound image stream along with a simultaneously acquired video-camera image stream, to achieve "image-transfer," i.e., the ability to warp one image on to the other to determine correspondence. One of the ways this is achieved is by using graphics processors (GPUs) to do the processing at frame rate.

In particular, in accordance with the present disclosure there is provided an audio camera having a plurality of microphones for generating audio data. The audio camera further has a processing unit configured for computing acoustical intensities corresponding to different spatial directions of the audio data, and for generating audio images corresponding to the acoustical intensities at a given frame rate. The processing unit includes at least one graphics processor; at least one multi-channel preamplifier for receiving, amplifying and filtering the audio data to generate at least one audio stream; and at least one data acquisition card for sampling each of the at least one audio stream and outputting data to the at least one graphics processor. The processing unit is configured for performing joint processing of the audio images and video images acquired by a video camera by relating points in the audio camera's coordinate system directly to pixels in the video camera's coordinate system. Additionally, the processing unit is further configured for accounting for spatial differences in the location of the audio camera and the video camera. The joint processing is performed at frame rate.

In accordance with the present disclosure there is also provided a method for jointly acquiring and processing audio and video data. The method includes acquiring audio data using an audio camera having a plurality of microphones; acquiring video data using a video camera, the video data including at least one video image; computing acoustical intensities corresponding to different spatial directions of the audio data; generating at least one audio image corresponding to the acoustical intensities at a given frame rate; and transferring at least a portion of the at least one audio image to the at least one video image. The method further includes relating points in the audio camera's coordinate system directly to pixels in the video camera's coordinate system; and accounting for spatial differences in the location of the audio camera and the video camera. The transferring step occurs at frame rate.

In accordance with the present disclosure, there is also provided a computing device for jointly acquiring and processing audio and video data. The computing device includes a processing unit. The processing unit includes means for receiving audio data acquired by a microphone array having a plurality of microphones; means for receiving video data acquired by a video camera, the video data including at least one video image; means for computing acoustical intensities corresponding to different spatial directions of the audio data; means for generating at least one audio image corresponding to the acoustical intensities at a given frame rate; and means for transferring at least a portion of the at least one audio image to the at least one video image at frame rate.

The computing device further includes a display for displaying an image which includes the portion of the at least one audio image and at least a portion of the video image. The computing device further includes means for identifying the location of an audio source corresponding to the audio data, and means for indicating the location of the audio source. The computing device is selected from the group consisting of a handheld device and a personal computer.

DETAILED DESCRIPTION

I. Real Time Capture of Audio Images and Their Use with Video

A. Beamforming

Beamforming with Spherical Microphone Arrays:

Let sound be captured at N microphones at locations $\Theta_s=(\theta_s, \phi_s)$ on the surface of a solid spherical array. Two approaches to the beamforming weights are possible. The modal approach relies on orthogonality of the spherical harmonics and quadrature on the sphere, and decomposes the frequency dependence. It however requires knowledge of quadrature weights, and theoretically for a quadrature order P (whose square is related to the number of microphones S) can only achieve beampatterns of order P/2. The other requires the solution of interpolation problems of size S (potentially at each frequency), and building of a table of weights. In each case, to beamform the signal in direction $\Theta=(\theta,\phi)$ at frequency f (corresponding to wavenumber $k=2\pi f/c$, where c is the sound speed), we sum up the Fourier transform of the pressure at the different microphones, $d_s^k$ as $$\psi(\Theta; k) = \sum_{s=1}^{s} w_N(\Theta, \Theta_s, ka) d_s^k(\Theta_s). \tag{1}$$

In the modal case (J. Meyer & G. Elko, 2002, A Highly Scalable Spherical Microphone Array Based on an Orthonormal Decomposition of the Soundfield, IEEE ICASSP 2002, vol. 2, pp. 1781-1784, the entire contents of which are herein incorporated by reference), the weights $w_N$ are related to the quadrature weights $C_n^m$ for the locations $\{\Theta_s\}$, and the $b_N$ coefficients obtained from the scattering solution of a plane wave off a solid sphere $$w_N(\Theta, \Theta_s, ka) = \sum_{n=0}^{N} \frac{1}{2i^n b_n(ka)} \sum_{m=-n}^{n} Y_n^{m*}(\Theta) Y_n^m(\Theta_s) C_n^m(\Theta_s). \quad (2)$$

For the placement of microphones at special quadrature points, a set of unity quadrature weights $C_n^m$ are achieved. In practice, it was observed that for $\{\Theta_s\}$ at the the so-called Fliege points, higher order beampatterns were achieved with some noise (approaching that achievable by interpolation $(N+1)=\sqrt{S}$). In our beamformer, we use one order lower than this limit, and the Fliege microphone locations, though we also consider the case where weights are generated separately and stored in a table.

Figure 1:
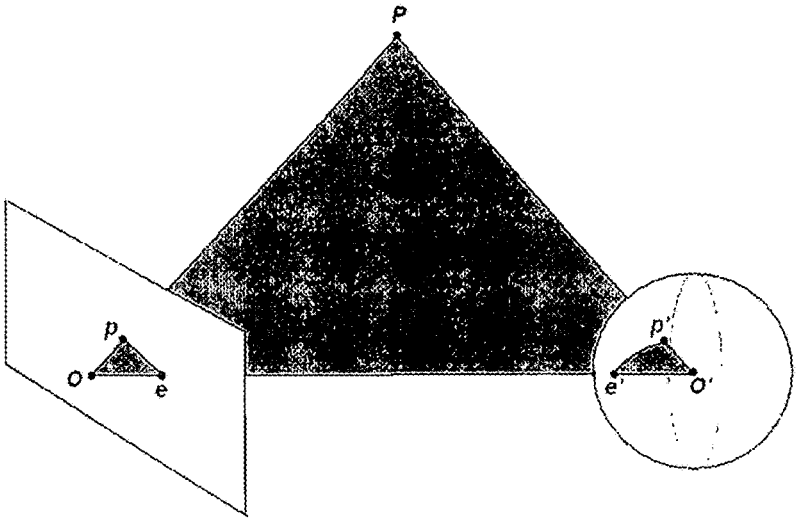
FIG. 1 depicts epipolar geometry between a video camera (left), and a spherical array sound camera. The world point P and its image point p on the left are connected via a line passing through PO. Thus, in the right image, the corresponding image point p lies on a curve which is the image of this line (and vice versa, for image points in the right video camera).
Figure 2:
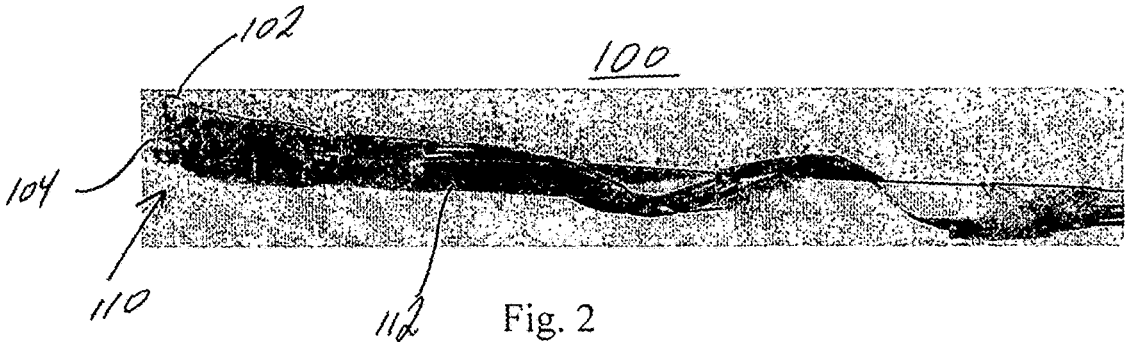
FIG. 2 shows a calibration wand consisting of a micro-speaker and an LED, collocated at the end of a pencil, which was used to obtain the fundamental matrix.

Joint Audio-Video Processing and Calibration:

In A. O'Donovan, R. Duraiswami, and J. Neumann, Microphone Arrays as Generalized Cameras for Integrated Audio Visual Processing, Proc. IEEE CVPR, 2007, there is provided a detailed outline of how to use cameras and spherical arrays together and determine the geometric locations of a source. The key observation was that the intensity image at different frequencies created via beamforming using a spherical array could be treated as a central projection (CP) camera, since the intensity at each "pixel" is associated with a ray (or its spherical harmonic reconstruction to a certain order). When two CP cameras observe a scene, they share an "epipolar geometry" (FIG. 1). Given two cameras and several correspondences (via a calibration object such as the calibration wand 100 shown in FIG. 2), a fundamental matrix that encodes the calibration parameters of the camera and the parameters of the relative transformation (rotation and translation) between the two camera frames can be computed. Given a fundamental matrix of a stereo rig, points can be taken in one camera's coordinate system and related directly to pixels in the second camera's coordinate system. Given more video cameras, a complete solution of the 3D scene structure common to the two cameras can be made, and "image transfer" that allows the transfer of the audio intensity information to actual scene objects made precisely. Given a single camera and a microphone array, the transfer can be accomplished if we assume that the world is planar (or that it is on the surface of a sphere) at a certain range.

General Purpose GPU Processing:

Recently graphics processors (GPUs) have become an incredibly powerful computing workhorse for processing computationally intensive highly parallel tasks. Recently NVidia released the Compute Unified Device Architecture (CUDA) along with the G8800 GPU with a theoretical peak speed of 330 Gflops, which is over two orders of magnitude larger than that of a state of the art Intel processor. This release provides a C-like API for coding the individual processors on the GPU that makes general purpose GPU programming much more accessible. CUDA programming, however still requires much trial and error, and understanding of the nonuniform memory architecture to map a problem on to it. In the present disclosure we (referring to the Applicants) map the beamforming, image creation, image transfer, and beamformed signal computation problems to the GPU to achieve a frame-rate audiovideo camera.

B. Exemplary System Setup

Figure 3:
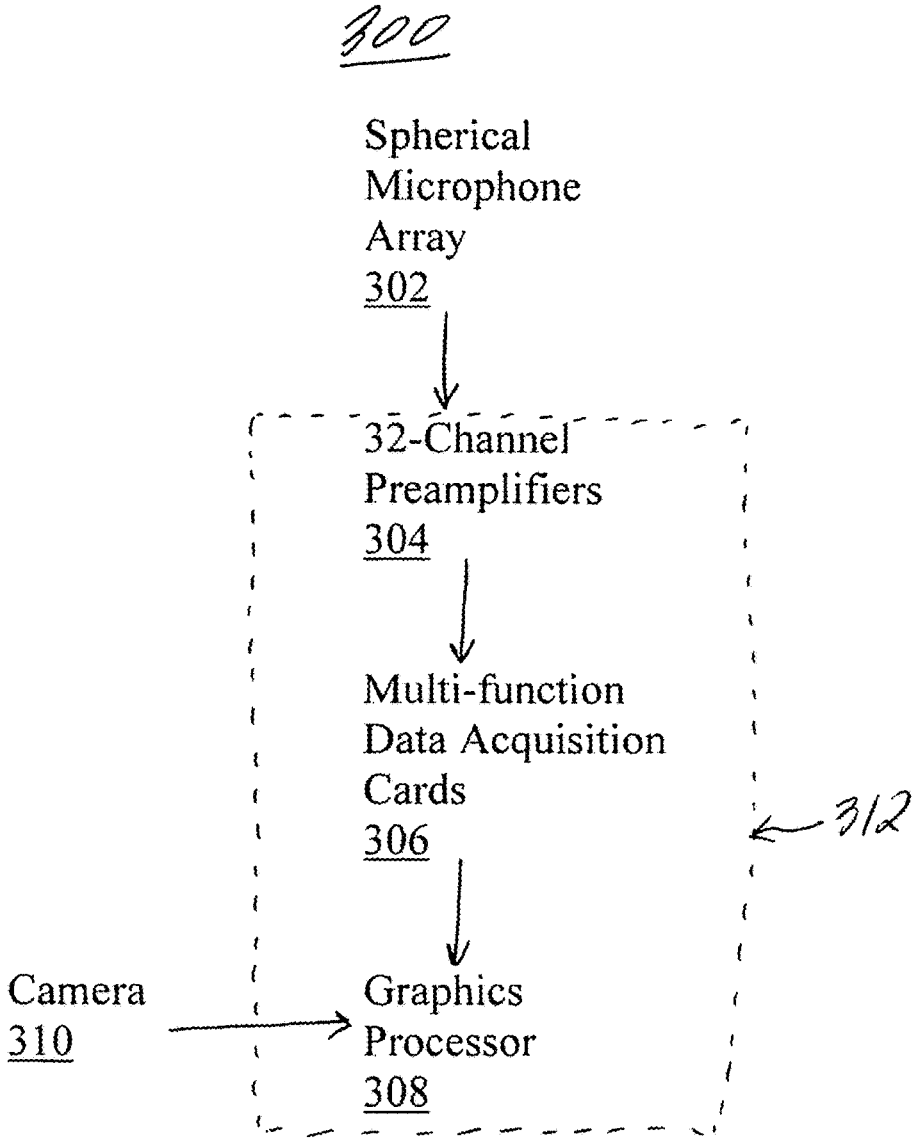
FIG. 3 shows a block diagram of a camera and spherical array system consisting of a camera and microphone sperical array in accordance with the present disclosure.

With reference to FIG. 3, audio information was acquired using a previously developed solid spherical microphone array 302 of radius 10 cm whose surface was embedded with 60 microphones. The signals from the microphones are amplified and filtered using two custom 32-channel preamplifiers 304 and fed to two National Instruments PCIe-6259 multi-function data acquisition cards 306. Each audio stream is sampled at a rate of 31250 samples per second. The acquired audio is then transmitted to an NVidia G8800 GTX GPU 308 installed in a computer running Windows® with an Intel Core2 processor and a clock speed of 2.4 GHz with 2 GB of RAM. The NVidia 08800 GTX GPU 308 utilizes a 16 SIMD multiprocessors with On-Chip Shared memory. Each of these multiprocessors is composed of eight separate processors that operate at 1.35 GHz for a total of 128 parallel processors. The G8800 GTX GPU 308 is also equipped with 768 MB of onboard memory. In addition to audio acquisition, video frames are also acquired from an orange micro IBot USB2.0 web camera 310 at a resolution of 640×480 pixels and a frame rate of 10 frames per second. The images are acquired using OpenCV and are immediately shipped to the onboard memory of the GPU 308. A block diagram of the system is shown by FIG. 3*a*.

The preamplifiers 304, data acquisition cards 306 and graphics processor 308 collectively form a processing unit 312. The processing unit 312 can include hardware, software, firmware and combinations thereof for performing the functions in accordance with the present disclosure.

C. Real-Time Processing

Since both pre-computed weights and analytically prescribed weights capable of being generated "on-the-fly" are used, we present the generation of images for both cases.

Pre-Computed Weights:

This algorithm proceeds in a two stage fashion: a pre-computation phase (run on the CPU) and a run-time GPU component. In stage 1 pixel locations are defined prior to run-time and the weights are computed using any optimization method as described in the literature. These weights are stored on disk and loaded at Runtime. In general the number of weights that must be computed for a given audio image is equal to P M F where P is the number of audio pixels, M is the number of microphones, and F is the number of frequencies to analyze. Each of these weights is a complex number of size 8 bytes.

After pre-computation and storage of the beamformer weights in the run-time component the weights are read from disk and shipped to the onboard memory of the GPU. A circular buffer of size 2048×64 is allocated in the CPU memory to temporarily store the incoming audio in a double buffering configuration. Every time 1024 samples are written to this buffer they are immediately shipped to a pre-allocated buffer on the GPU. While the GPU processes this frame the second half of the buffer is populated. This means that in order to process all of the data in real-time all of the processing must be completed in less then 33 ms, to not miss any data.

Once audio data is on the GPU we begin by performing an in place FFT using the cuFFT library in the NVidia CUDA SDK. A matrix vector product is then performed with each frequency's weight matrix and the corresponding row in the FFT data, using the NVidia CuBlas linear algebra library. The output image is segmented into 16 sub-images for each multi-processor to handle. Each multiprocessor is responsible for compiling the beamformed response power in three frequency bands into the RGB channels of the final pixel buffer object. Once this is completed control is restored to the CPU and the final image is displayed to the screen as a texture mapped quad in OpenGL.

On the Fly Weight Computation:

In this implementation there is a much smaller memory footprint. Where as we needed space to be allocated for weights on the GPU in the previous algorithm this one only needs to store the location of the microphones. At start up these locations are read from disk and shipped to the GPU memory. Efficient processing is achieved by making use of the addition theorem which states that $$P_n(\cos\gamma) = \frac{4\pi}{2n+1}\sum_{m=-n}^{n} Y_n^{-m}(\Theta)Y_n^m(\Theta_s) \tag{3}$$

where $\Theta$ is the spherical coordinate of the audio pixel and $\Theta_s$ is the location of the s th microphone, $\gamma$ is the angle between these two locations and $P_n$ is the Legendre polynomial of order n. This observation reduces the order $n^2$ sum in Eq. (2) to an order n sum. The $P_n$ are defined by a simple recursive formula that is quickly computed on the GPU for each audio pixel.

The computation of the audio proceeds as follows. First we load the audio signal onto the GPU and perform an inplace FFT. We then segment the audio image into 16 tiles and assign each tile to a multiprocessor of the GPU. Each thread in the execution is responsible for computing the response power of a single pixel in the audio image. The only data that the kernel needs to access is the location of the microphone in order to compute $\gamma$ and the Fourier coefficients of the 60 microphone signals for all frequencies to be displayed. The weights can then be computed using simple recursive formula for each of the Hankel, Bessel, and Legendre polynomials in Eq. (2).

While performance of the beamformer may be a bit worse, there are several benefits to the on-the-fly approach: 1) frequencies of interest can be changed at runtime with no additional overhead; 2) pixel locations can be changed at runtime with little additional overhead; 3) memory requirements are drastically lower then storing pre-computed weights.

Beamforming:

Once a source location of interest is identified, we can use the results of the beamforming to obtain the beamformed sound from that direction, by taking the beamforming results at frequencies of the microphone array effectiveness, and appending to that the frequencies from outside the band from the Fourier transform of the signal from the microphone closest to the direction.

D. Results

Figures 4A, 4B:
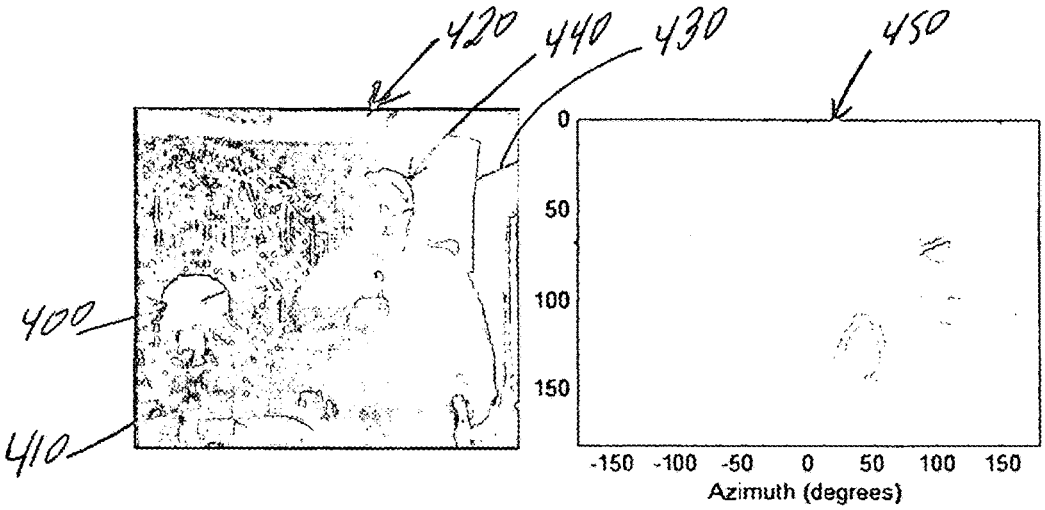
FIGS. 4*a* and 4*b*: A loud speaker source was played that overwhelmed the sound of the speaking person (FIG. 4*a*), whose face was detected with a face detector and the epipolar line corresponding to the mouth location in the vision image was drawn in the audio image (FIG. 4*b*). A search for a local audio intensity peak along this line in the audio image allowed precise steering of the beam, and made the speaker audible.

Vision Guided Beamforming:

Several authors have in the past proposed vision guided beamforming. The idea is that vision based constraints can help us to not steer the beamformer in directions that are not promising. Often these constraints require the source to lie in some constrained region. One crucial difference here is that the quality of the geometric constraints provided by the epipolar geometry is much stronger. We illustrate in FIG. 4*a* this example with a case where a speaker's voice is beamformed in the presence of severe noise using location information from vision. Using a calibrated array-camera combination having a spherical microphone array 400 and a camera 410 and computing hardware (see FIG. 3), we applied a standard face detection algorithm to the vision image 420 and then used the epipolar line 430 induced by the mouth region 440 of the vision image 420 to search for the source in the audio image 450 (FIG. 4*b*).

Image Transfer:

Noise source identification via acoustic holography seeks to determine the noise location from remote measurements of the acoustic field. Here we add the capacity to visually identify the source via automatic warping of the sound image. This implementation also has application to areas such as gunshot detection, meeting recording (identifying who's talking), etc. We used the method of precomputed weights. An audio image was generated at a rate of 30 frames per second and video was acquired at a rate of 10 frames per second. In order to reduce the effects of incoherent reverberation and spurious peaks we incorporated a temporal filter of the audio image prior to transfer. Once the audio image is generated a second GPU kernel is assigned to generate the image transfer overlay which is then alpha blended with the video frame.

The audio video stereo rig was calibrated according to A. O'Donovan, R. Duraiswami, and J. Neumann, Microphone Arrays as Generalized Cameras for Integrated Audio Visual Processing, Proc. IEEE CVPR, 2007, the entire contents of which are incorporated herein by reference. The audio image transfer is also performed in parallel on the GPU and the corresponding values are then mapped to a texture and displayed over the video frame. To decrease pixilation artifacts the kernel also performs bilinear interpolation. Though the video frames are only acquired at 10 frames per second the over-laid audio image achieves the same frame rate as the audio camera (30 frames per second).

Figures 5A, 5B:
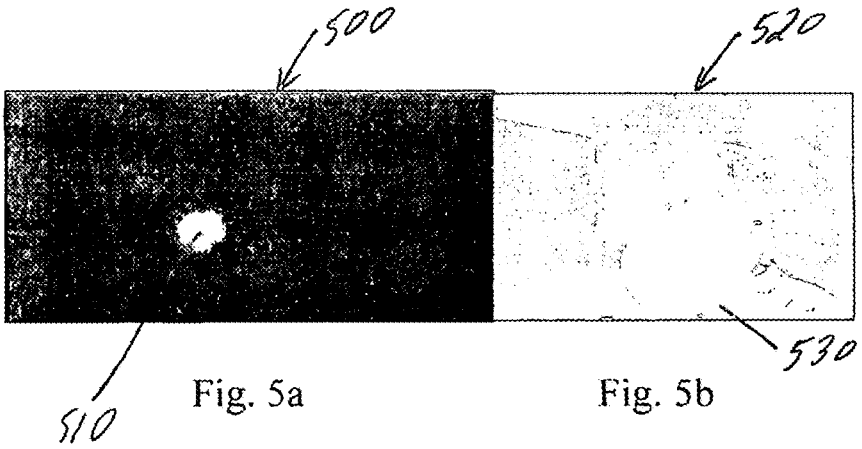
FIGS. 5*a* and 5*b* show an image transfer example of a person speaking. The spherical array image (FIG. 5*a*) shows a bright spot at the location corresponding to the mouth. This spot is automatically transferred to the video image (FIG. 5*b*) (where the spot is much bigger, since the pixel resolution of video is higher), identifying the noise location as the mouth.

Image Transfer Example:

A person speaks. The spherical array image 500 (FIG. 5*a*) shows a bright spot 510 at the location corresponding to the mouth. This spot 510 is automatically transferred to the video image 520 (FIG. 5*b*) (where the spot 530 is much bigger, since the pixel resolution of video is higher), identifying the noise location as the mouth.

II. Microphone Arrays as Generalized Cameras for Integrated Audio Visual Processing A. Motivation and Present Contribution In most previous work, the fusion of the audio-visual information occurs at a relatively late stage. In contrast, the present disclosure takes the viewpoint that both cameras and microphone arrays are geometry sensors, and treats the microphone arrays as generalized cameras. Computer-vision inspired algorithms are employed to treat the combined system of arrays and cameras. In particular, the present disclosure considers the geometry introduced by a general microphone array and spherical microphone arrays. The latter show a geometry that is very close to central projection cameras, and the present disclosure shows how standard vision based calibration algorithms can be profitably applied to them. Several experiments are presented herein that demonstrate the usefulness of the considered approach.

Arrays of microphones can be geometrically arranged and the sound captured can be used to extract information about the geometrical location of a source. Interest in this subject was raised by the idea of using a relatively new sensor and an associated beamforming algorithm for audiovisual meeting recordings (see FIGS. 4*a* and 4*b*). This array has since been the subject of some research in the audio community. While considering the use of the array to detect and to beamform (isolate) an auditory source in the meeting system, it was observed that this microphone array is a central projection device for far-field sound sources, and can be easily treated as a "camera" when used with more conventional video cameras. Moreover, certain calibration problems associated with the device can be solved using standard approaches in computer vision.

The present disclosure relates to spherical microphone arrays. However, we (referring to the applicants) were naturally led to how other microphone arrays could be included in the framework as generalized cameras, similar to the recent work in vision on generalized cameras, that are imaging devices that do not restrict themselves to the geometric or photometric constraints imposed by the pinhole camera model, including the calibration of such generalized bundles of rays. In the most general case, any camera is simply a directional sensor of varying accuracy.

Microphone arrays that are able to constrain the location of a source can be interpreted as directional sensors. Due to this conceptual similarity between cameras and microphone arrays, it is possible to utilize the vast body of knowledge about how to calibrate cameras (i.e. directional sensors) based on image correspondences (i.e. directional correspondences). Specifically, the fact that spherical arrays of microphones can be approximated as directional sensors which follow a central projection geometry is utilized. Nevertheless, the constraints imposed by the central projection geometry allow the application of proven algorithms developed in the computer vision community as described in the literature to calibrate arbitrary combinations of conventional cameras and spherical microphone arrays.

Below there is a brief review of some relevant work. Next, in section C, there is provided so e background material on audio processing, to make the present disclosure self contained, and to establish notation. Section D describes the algorithms developed for working with the spherical array and cameras, and results are described. Section E has conclusions and discusses applications of the teachings according to the present disclosure to other types of microphone arrays.

B. Prior Work

Microphone arrays have long been used in many fields (e.g., to detect underwater noise sources), to record music, and more recently for recording speech and other sound. The latter is of concern here, and there is a vast literature on the area. An introduction to the field may be obtained via a pair of books that are collections of invited papers that cover different aspects of the field (M. S. Brandstein and D. B. Ward (editors), Microphone Arrays: Signal Processing Techniques and Applications, Springer-Verlag, Berlin, Germany, 2001; Y. A. Huang and J. Benesty, ed. Audio Signal Processing For Next Generation Multimedia Communication Systems, Kluwer Academic Publishers 2004). Solid spherical microphone arrays were first developed (both theoretically and experimentally) by Meyer and Elko (J. Meyer and G. Elko. "A highly scalable spherical microphone array based on anorthonormal decomposition of the soundfield," Proceedings IEEE ICASSP, 2:1781-1784, 2002; J. Meyer and G. Elko, "Spherical Microphone Arrays for 3D sound Recording," Audio Signal Processing For Next Generation Multimedia Communication Systems Ed. Y. A. Huang and J. Benesty, 67-89, Kluwer Academic Publishers 2004) and extended by Li et al. (Z. Li, R. Duraiswami, E. Grassi, and L. S. Davis, "Flexible layout and optimal cancellation of the orthonormality error for spherical microphone arrays," Proceedings IEEE ICASSP, 4:41-44, 2004; Z. Li and Ramani Duraiswarni; "Hemispherical microphone arrays for sound capture and beamforming," Proceedings IEEE WASPAA, 106-109, 2005).

There are several papers that consider combined audio visual processing. Pointing a pan-tilt-zoom camera at a sound source has been achieved by several authors, while a few employ the knowledge of the location of the sound source obtained from vision to improve the audio processing. Several authors have performed joint audio-visual tracking using various approaches (particle filtering, learning a probabilistic graphical model using low level audio and visual features, finding the pixels that create sound via an efficient formulation of canonical correlation analysis, and built a large efficient industrial system). Modern image processing and computer vision techniques were used to define new features for sound recognition.

One paper describes the development of the joint geometry of an underwater sonar camera system (Shahriar Negandaripour, "Epipolar Geometry of Opti-Acoustic Stereo Imaging," IEEE Transactions on Pattern Analysis and Machine Intelligence, 2007). There is a difference however in the methods used in that paper, which relies on active probing of the scene using acoustic pulses, and then images it rather like LADAR, using a time of flight map for the reflected signals. Due to the large error in the 3rd coordinate of their estimates the authors chose to treat the sensor as a 2D sensor, with the two retained image dimensions as range and one angular coordinate. In contrast, the present disclosure discusses microphone arrays whose "image" geometry is similar to that in regular central projection cameras, and do not actively probe the scene but rely on sounds created in the environment. The sensor described herein would be useful in indoor people and industrial noise monitoring situations, while the sensor described by Shahriar Negandaripour would be useful in underwater imaging.

C. Background

C.1. Source Localization and Beamforming

Assume that the acoustic source that produces an acoustic signal y(t) is located at point p and K microphones are located at points $q_1, \ldots, q_k$. The signal $s_m(t)$ (received at the $m^{th}$ microphone contains delayed versions of the source signal, its convolution with the channel impulse response, and noise (or other sources) and is given by $$s_m(t)=r_m^{-1}y(t-\tau_m)+y(t)*h^*_m(q_m,p,t)+z_m(t). \quad (4)$$

where the first term on the right is the direct arriving signal, $r_m=\|p-q_m\|$ is the distance from the source to the m th microphone, c is the sound speed, $\tau_m=r_m/c$ is the delay in the signal reaching the microphone, $h^*_m(q_m,p,t)$ is the filter that models the reverberant reflections (called the room impulse response, RIR) for the given locations of the source and the $m^{th}$ microphone, star denotes convolution, and $z_m(t)$ is the combination of the channel noise, environmental noise, or other sources; it is assumed to be independent at all microphones and uncorrelated with y(t).

In general $\tau_m$ will not be measurable as the source position is unknown. Knowing the locations of two microphones, m and n respectively, We denote the time difference of arrival (TDOA) of a signal between receivers m and n as $\tau_{mn}=\tau_n-\tau_m$. TDOAs are usually obtained using a generalized cross-correlation (GCC) between signal frames (short pieces of the signal of length N) $s_m$ and $s_n$ acquired at the $m^{th}$ and $n^{th}$ sensors respectively (see R. Duraiswami et al., "System for capturing of high-order spatial audio using spherical microphone array and binaural head-tracked playback over headphones with HRTF cues," Proc. 119th convention AES, 2005). Let us denote by $r_{mn}(\tau)$ the GCC of $s_n(t)$ and $s_m(t)$ and its Fourier transform by $R_{mn}(\omega)$. Then, $$R_{mn}(\omega)=W_{mn}(\omega)S_m(\omega)S^*_n(\omega), \quad (5)$$

where $W_{mn}(\omega)$ is a weighting function. Ideally, $r_{mn}(\tau)$ (computed as the inverse Fourier transform of $R_{mn}(\omega)$) will have a peak at the true TDOA between sensors m and n ($\tau_{mn}$). In practice, many factors such as noise, finite sampling rate, interfering sources and reverberation might affect the position and the magnitude of the peaks of the cross correlation, and the choice of the weighting function can improve the robustness of the estimator. The phase transform (PHAT) weighting function was introduced in C. H. Knapp and G. C. Carter, "The generalized correlation method for estimation of time delay", IEEE Transactions on Acoustics, Speech and Signal Processing, 24:320-327, 1976:

$$W_{mn}(\omega)=|S_m(\omega)S^*_n(\omega)|^{-1}. \tag{6}$$

The PHAT weighting places equal importance on each frequency by dividing the spectrum by its magnitude. It was later shown that it is more robust and reliable in realistic reverberant acoustic conditions than other weighting functions designed to be statistically optimal under specific non-reverberant noise conditions.

Figure 7:
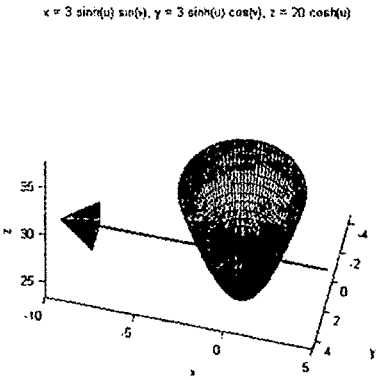
FIG. 7 graphically illustrates a ray from a camera to a possible sound generating object, and its intersection with the hyperboloid of revolution induced by a time delay of arrival between a pair of microphones. The source lies at either of the two intersections of the hyperboloid and the ray.

Source Localization Using Time Delays:

The availability of a single time delay between a pair of receivers, places the source on a hyperboloid of revolution of two sheets, with its foci at the two microphones (see FIG. 7). In human hearing, time delays between the two ears places the source on this hyperboloid (also mislabeled the "cone of confusion"), and humans have to use other cues to resolve ambiguities. In general purpose arrays, additional microphones can be added, and intersect the hyperboloids formed by delay measurements with each pair. Measurements at three collinear microphones restrict the source to lie on a circle whose center lies on the axis formed by the microphones, while knowing the time delays between 4 non-collinear microphones in principle can provide the exact source location. However, TDOAs are very noisy, and the non-linear intersection algorithms may give poor results with the noisy input data, and various methods to improve the algorithms are still being developed by researchers.

Beamforming:

The goal of beamforming is to "steer" a "beam" towards the source of interest and to pick its contents up in preference to any other competing sources or noise. The simplest "delay and sum" beamformer takes a set of TDOAs (which determine where the beamformer is steered) and computes the output $s_B(t)$ as $$s_B(t) = \frac{1}{K}\sum_{m=1}^{K} s_m(t+\tau_{ml}), \tag{7}$$

where l is a reference microphone which can be chosen to be the closest microphone to the sound source so that all $\tau_{ml}$ are negative and the beamformer is causal. To steer the beamformer, one selects TDOAs corresponding to a known source location. Noise from other directions will add incoherently, and decrease by a factor of $K^{-1}$ relative to the the source signal which adds up coherently, and the beamformed signal is clear. More general beamformers use all the information in the K microphone signal at a frame of length N, may work with a Fourier representation, and may explicitly null out signals from particular locations (usually directions) while enhancing signals from other locations (directions). The weights are then usually computed in a constrained optimization framework.

Beampattern:

The pattern formed when the, usually frequency-dependent, weights of a beamformer are plotted as an intensity map versus location are called the beampattern of the beamformer. Since usually beamformers are built for different directions (as opposed to location), for source that are in the "far-field," the beampattern is a function of two angular variables. Allowing the beampattern to vary with frequency gives greater flexibility, at an increased optimization cost and an increased complexity of implementation.

Localization Via Steered Beamforming:

One way to perform source localization is to avoid nonlinear inversion, and scan space using a beamformer. For example, if using the delay and sum beamformer the set of time delays $\hat{\tau}_{mn}$ corresponds to different points in the world being checked for the position of a desired acoustic source, and a map of the beamformer power versus position may be plotted. Peaks of this function will indicate the location of the sound source. There are various algorithms to speed up the search.

C.2. Spherical Microphone Arrays

The present disclosure is concerned with solid spherical microphone arrays (as in FIGS. 3 and 4) on whose surface several microphones are embedded. In J. Meyer and G. Elko, "A highly scalable spherical microphone array based on anorthonormal decomposition of the soundfield," Proceedings IEEE ICASSP, 2:1781-1784, 2002, an elegant prescription that provided beamformer weights that would achieve as a beampattern any spherical harmonic function $Y_n^m(\theta_k,\phi_k)$ of a particular order n and degree m in a direction, $(\theta_k, \phi_k)$ was presented. Here $$Y_n^m(\theta,\varphi) = (-1)^m\sqrt{\frac{2n+1(n-|m|)!}{4\pi(n+|m|)!}}\,P_n^{|m|}(\cos\theta)e^{im\varphi} \tag{8}$$

where n=0, 1, 2, . . . and m=−n, . . . , n, and $P_n^{|m|}$ is the associate Legendre function. The maximum order that was achievable by a given array was governed by the number of microphones, S, on the surface of the array, and the availability of spherical quadrature formulae for the points corresponding to the microphone coordinates $(\theta_k,\phi_k)$ i=1, . . . , S. In Li, R. Duraiswami, E. Grassi, and L. S. Davis, "Flexible layout and optimal cancellation of the orthonormality error for spherical microphone arrays," Proceedings IEEE ICASSP, 4:41-44, 2004, the analysis is extended to arbitrarily placed microphones on the sphere.

Since the spherical harmonics form a basis on the surface of the sphere, building the spherical harmonic expansion of a desired beampattern, allowed easy computation of the weights necessary to achieve it. In particular if one desires a beampattern that is a delta function, truncated to the maximum achievable spherical harmonic order p, in a particular direction $(\phi_0,\phi_0)$, then the following algorithm can be used $$\delta^{(p)}(\theta-\theta_0,\varphi-\varphi_0) = 2\pi\sum_{n=o}^{p-1}\sum_{m=-n}^{n} Y_n^{m*}(\theta_0,\varphi_0)Y_n^m(\theta,\varphi), , \tag{9}$$

to compute the weights for any desired look direction. This beampattern is often called the "ideal beampattern," since it enables picking out a particular source. The beampattern achieved at order 6 is shown in FIG. 3. A spherical array can be used to localize sound sources by steering it in several directions and looking at peaks in the resulting intensity mage formed by the array response in different directions.

The ability of an array to isolate a sound source from a given look direction is often quantified by the directivity index and is given in dB:

$$DI(\theta_0, \theta_s, ka) = 10\log_{10}\left[\frac{4\pi|H(\theta_0, \theta_0)|^2}{\int_{\Omega_s}|H(\theta, \theta_0)|^2\, d\Omega_s}\right] \quad (10)$$

where $H(\theta,\theta_0)$ is the actual beampattern looking at $\theta_0$–$(\theta_0, \phi_0)$ and $H(\theta_0, \theta_0)$ is the value in that direction. The DI is the ratio of the gain for the look direction $\theta_0$ to the average gain over all directions. If a spherical microphone array can precisely achieve the regular beampattern of order N as described in Z. Li and Ramani Duraiswami, "Flexible and Optimal Design of Spherical Microphone Arrays for Beamforming," IEEE Transactions on Audio, Speech and Language Processing, 15:702-714, 2007, its theoretical DI is 20 $\log_{10}(N+1)$. In practice, the DI index will be slightly lower than the theoretical optimal due to errors in microphone location and signal noise.

Spherical microphone arrays can be considered as central projection cameras. Using the ideal beam pattern of a particular order, and beamforming towards a fixed grid of directions, one can build an intensity map of a sound field in particular directions. Peaks will be observed in those directions where sound sources are present (or the sound field has a peak due to reflection and constructive interference). Since the weights can be pre-computed and a relatively short fixed filters, the process of sound field imaging can proceed quite quickly. When sounds are created by objects that are also visualized using a central projection camera, or are recorded via a second spherical microphone array, an epipolar geometry holds between the camera and the array, or the two arrays. Below experiments which were conducted by us (referring to the applicants) are described which confirm this hypothesis.

D. Experiments with Spherical Arrays and Cameras

A 60-microphone spherical microphone array of radius 10 cm was constructed. A 64 channel signal acquisition interface was built using PCI-bus data acquisition cards that are mounted in the analysis computer and connected to the array, and the associated signal processing apparatus. This array can capture sound to disk and to memory via a Matlab data acquisition interface that can acquire each channel at 40 kHz, so that a Nyquist frequency of 20 kHz is achieved. The same Matlab was equipped with an image-processing toolbox, and camera images were acquired via a USB 2.0 interface on the computer. A 320×240 pixel, 30 frames per second web camera was used. While, the algorithms should be capable of real-time operation, if they were to be programmed in a compiled language and linked via the Matlab mex interface, in the present work this was not done, and previously captured audio and video data were processed subsequently.

Camera and Array Calibration:

The camera was calibrated using standard camera calibration algorithms in OpenCV, while the array microphone intensities were calibrated as described in the spherical array literature. We then proceeded with the task of relative calibration of the array 302 (FIG. 3) and the camera 310. To calibrate this system 300, we built a wand 100 that has an LED 102 and a small speaker 104 (both about 3 mm×3 mm) collocated at the tip or end 110 of a pencil 112 (see FIG. 2). When a button is pressed, the LED 102 lights up and a sound chirp is simultaneously emitted from the speaker 104. Light and sound are then simultaneously recorded by the camera and microphone array respectively. We can determine the direction of the sound by forming a beam pattern as described above which turns the microphone array into a directional sensor.

Figure 6:
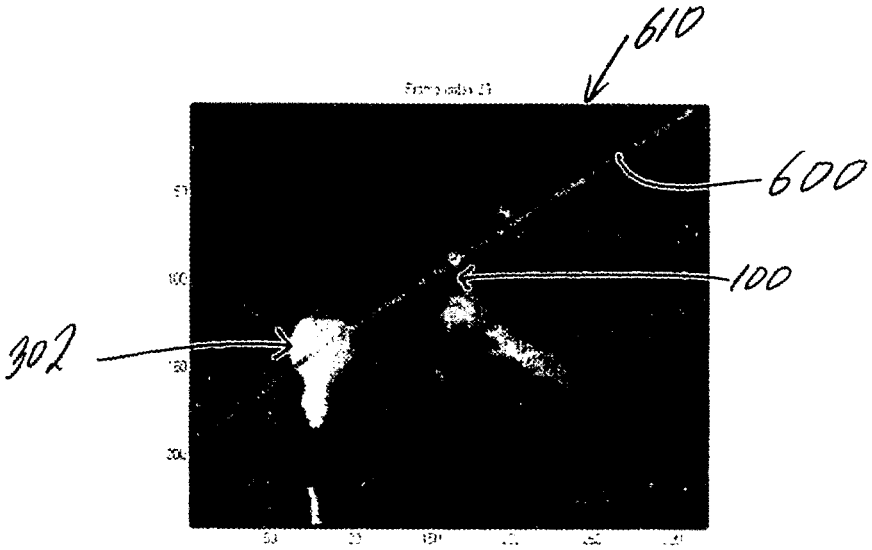
FIG. 6 shows a camera image of a calibration procedure.

In FIG. 6 there is shown an example sample acquisition. Notice the epipolar line 600 passing through the microphone array 302 having a plurality of microphones as the user holds the calibration wand 100 in the camera image 610.

As one can see the calibration recovered the epipolar geometry between the camera 310 and the array 302 very accurately. The same procedure can also be used to calibrate several (hemi-)spherical microphone arrays since both are equivalent to internally calibrated cameras, and thus also have to conform to the epipolar geometry. FIG. 1 shows how the image ray projects into the spherical array and intersects the peak of the beam pattern.

D.1. One Camera and One Spherical Array

In this case, the camera image and "sound image" are related by the epipolar geometry induced by the orientation and location of the camera and the microphone array respectively. We will assume that the camera is located at the origin of the fiducial coordinate system. For each sound we thus have the direction $r_{mic}(\theta,\phi)$, which we need to correspond to the projection of the 3D location of the sound source into the camera image $p_{cam}$.

If we have precalibrated the camera, then we can transform $p_{cam}$ into normalized image coordinates $r_{cam}=K^{-1}p_{cam}$ where K is the internal calibration matrix of the camera (we disregard the radial distortion parameters). If the camera coordinate system and the microphone coordinate system are related by a rotation matrix R and a translation vector T, then each correspondence is related by the essential matrix E:

$$0=r^t_{mic}Er_{cam}=r^t_{mic}[T]_xRr_{cam} \quad (10)$$

To compute the essential matrix E and extract T and R, we follow Y. Ma, J. Kosecka, and S. S. Sastry, "Motion recovery from image sequences: Discrete viewpoint vs. differential viewpoint," Proceedings ECCV, 2:337-353, 1998. We decide among the resulting four solutions by choosing the solution that maximizes the number of positive depths for the microphone array and the camera.

If the camera is not calibrated, then the direction in the microphone and the pixel in the image would be related by the fundamental matrix F: We can solve for F using a multitude of algorithms as described in Hanley and A. Zisserman, Multiple View Geometry in Computer Vision. Cambridge University Press, Cambridge, UK, 2000, we chose to use a linear algorithm for which we need at least 8 correspondences, followed by non-linear minimization that takes into account the different noise characteristics of the image and microphone array "image" formation process.

The epipolar geometry induces by the essential or fundamental matrices, allows us interchangeably to transfer a point from an image to a 1-D space in the microphone array directional space defined by $r_{mic}(\theta,\phi)\cdot(Fp_{cam})=0$, or a directional measurement from the microphone array to an epipolar line defined by the equation $p_{cam}\cdot(F^tr_{mic})=0$.

D.2. N Cameras and One Spherical Array

Multicamera systems with overlapping fields of view, attached to microphone arrays are now becoming popular to record meetings. The location of speakers in an integrated mosaic image is a problem of interest in such systems. For multiple cameras, we only need to know the calibration information from two cameras, to use a method similar to the one described in J. P. Barreto and K. Daniilidis, "Wide area multiple camera calibration and estimation of radial distortion," OMNIVIS 2004-Workshop on Omnidirectional Vision and Camera Networks, Prague, Czech Republic, 2004 to calibrate the remaining cameras. Since the microphone is already intrinsically calibrated, we only need to determine the internal calibration parameters for a single camera, compute the calibration between the spherical array and the calibrated camera, reconstruct the correspondences in space, and then use the 3D points to calibrate the system of cameras as described by Barreto et al. The results could then be further improved using bundle-adjustment as described in B. Triggs, P. F. McLauchlan, R. L Hartley, and A. W. Fitzgibbon, "Bundle adjustment—a modern synthesis," B. Triggs, A. Zisserman, and R. Szeliski, editors, Vision Algorithms: Theory and Practice, LNCS:1883. Springer-Verlag, 298-373, 1999.

Similarly, one could also use two (hemi-)-spherical microphone arrays, and an arbitrary number of uncalibrated cameras. First, we can calibrate the two microphone arrays using the epipolar constraint as described earlier. Then we can reconstruct the calibration points in space using the computed calibration. Due to the omnidirectional nature of the microphone array, we can be sure that all the calibration points are "visible" to both microphone arrays and thus can be reconstructed. We can now use the reconstructed structure to compute the projection matrices for each of the cameras. We can now use all the cameras and the microphone arrays together with the reconstructed points to initialize a bundle-adjustment procedure.

D.3. Example Application: Speaker Tracking and Noise Suppression

Using the epipolar geometry between a spherical microphone array and a camera in a meeting room scenario. The microphone array was used to detect the direction of sound sources in the scene, in this case the speaker in the room, and then the epipolar geometry, to project the epipolar line into the camera image. We can now employ a simple face detector along the vicinity of the epipolar line to located the exact position of the speaker in the image. In our system we use a face detector based on Haar wavelets as implemented in OpenCV (see R. Lienhart, L. Liang, and A. Kuranov, "A detector tree of boosted classifiers for real-time object detection and tracking," Proceedings IEEE ICME, 2:277-280, 2003). This allows us then to accurately zoom into the image and display a detailed view of the speaker. Since the search space is greatly reduced, the localization can be done extremely fast, and also switching from one speaker to the next can be done instantly.

In FIG. 4*b* there is shown the sound image where the peak indicates the mouth region, this peak is located and using the epipolar geometry projected into the image resulting in a epipolar line. We now search along this line for the most likely face position, triangulate the position in space and then set our zoom level accordingly.

The knowledge of the face location can help improve the recorded audio as well. We will now present an example in which an extremely loud music interference was played from a location to the left of the subject, and below him, after the face was initially detected as above. Once the face rectangle was extracted, a template match was used to detect the mouth region. The epipolar line from the image passing through this region was then constructed on the soundfield image. The lower panel of FIG. 4 shows the sound field image generated, where the distracter can be seen to be extremely bright compared to the source. The location corresponding to the mouth was passed to the beamforming algorithms, and the sound from this location was extracted. A further refinement of the algorithm could be to throw an explicit null at the location of the other source.

E. Conclusions and Other Considerations

In accordance with the present disclosure, there is presented a novel approach that considers the geometrical restrictions introduced by microphone array measurements, and those introduced by cameras in a joint framework, which allows localization and calibration problems to be more efficiently solved. The theoretical sections above consider the general situation, and then the case of the spherical array is described in detail. The ideas were validated experimentally.

We believe that the approach considered here, of imaging the sound field using a spherical array(s) and the actual scene using camera(s) will have many applications, and several vision algorithms can be brought to bear. For example, when multiple cameras will be used with multiple spherical arrays, we can build a joint mosaic of the image and the soundfield image. Such an analysis can easily indicate locations where sounds are being created, their intensity and frequencies. This may have applications in industrial monitoring and surveillance.

The audio camera in accordance with the present disclosure and its accompanying software and processing circuitry can be incorporated or provided to computing devices having regular microphone arrays. The computing devices include handheld devices (mobile phones and personal digital assistants (PDAs)), and personal computers. The microphone arrays provided to these computing devices often include cameras in them or cameras connected to them as well. In such computing devices, these microphones are used to perform echo and noise cancellation. Other locations where such arrays may be found include at the corners of screens, and in the base of video-conferencing systems. Using time delays, one can restrict the audio source to lie on a hyperboloid of revolution, or when several microphones are present, at their intersection. If the processing of the camera image is performed in a joint framework, then the location of the audio source can be quickly performed in accordance with the present disclosure, as is indicated in FIG. 7.

It would also be useful to consider some specialized systems where the camera and microphones are placed in a particular geometry. For example, the human head can be considered to contain two cameras with two microphones on a rigid sphere. A joint analysis of the ability of this system to localize sound creating objects located at different points in space using both audio and visual processing means could be of broad interest.

The contents of all references cited above are incorporated herein by reference in their entirety.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

III. Spherical Microphone Array Based Immersive Audio Scene Rendering

A. Abstract

In many applications such as entertainment, education, military training, remote telepresence, surveillance, etc. it is necessary to capture an acoustic field and present it to listeners with a goal of creating the same acoustic perception for them as if they were actually present at the scene. Currently, there is much interest in the use of spherical microphone arrays for acoustic scene capture and reproduction. We describe a 32-microphone spherical array based system implemented for spatial audio capture and reproduction. Our array embeds hardware that is traditionally external, such as preamplifiers, filters, digital-to-analog converters, and USB adaptor, resulting in a portable lightweight solution and requiring no hardware on the PC side whatsoever other than a high-speed USB port. We provide capability analysis of the array and describe software suite developed for the application.

B. Introduction

An important problem related to spatial audio is capture and reproduction of arbitrary acoustic fields. When a human listens to an audio scene, much information is extracted by the brain from the audio streams, including the number of competing foreground sources, their directions, environmental characteristics, presence of background sources, etc. It would be beneficial for many applications if such an arbitrary acoustic scene could be captured and reproduced with perceptual accuracy. Since audio signals received at the ears change with listener motion, the same effect should be present in the rendered scene. This can be done by the use of a loudspeaker array that attempts to recreate the whole scene in a region or by a head-tracked headphone setup that does it for an individual listener. We focus on headphone presentation.

The key property required from the acoustic scene capture algorithm is the ability to preserve the directionality of the field in order to render those directional components properly later. While the recording of an acoustic field with a single microphone faithfully preserves the variations in acoustic pressure at the point where the recording was made (assuming an omnidirectional microphone), it is impossible to infer the directional structure of the field from that recording.

A microphone array can be used to infer directionality from sampled spatial variations of the acoustic field. One of the earlier attempts to do that was the use of Ambisonics technique and the Soundfield microphone (see R. K. Furness (1990). "Ambisonics—An overview", Proc. 8th AES Intl. Conf., Washington, D.C. pp. 181-189) to capture the acoustic field and its three first-order derivatives along the coordinate axes. While a certain sense of directionality can be achieved with Ambisonics reproduction, the reproduced sound field is only a rough approximation of the original one. The Ambisonics reproduction includes only the first-order spherical harmonics, while accurate reproduction would require order of about 10 for the frequencies up to 8-10 kHz. Recently, researchers turned to using spherical microphone arrays (see T. D. Abhayapala and D. B. Ward (2002). "Theory and design of high order sound field microphones using spherical microphone array", Proc. IEEE ICASSP 2002, Orlando, Fla., vol. 2, pp. 1949-1952; and J. Meyer and G. Elko (2002). "A highly scalable spherical microphone array based on an orthonormal de-composition of the soundfield", Proc. IEEE ICASSP 2002, Orlando, Fla., vol. 2, pp. 1781-1784) for spatial structure preserving acoustic scene capture. They exhibit a number of properties making them especially suitable for this application, including omnidirectionality, beamforming pattern independent of the steering direction, elegant mathematical framework for digital beam steering, and ability to utilize wave scattering off the spherical support to improve directionality. Once the directional components of the field are found, they can be used to present the acoustic field to the listener by rendering those components to appear as arriving from appropriate directions. Such rendering can be done using traditional virtual audio methods (i.e., filtering with the head-related transfer function (HRTF)) (see R. Duraiswami, D. N. Zotkin, Z. Li, E. Grassi, N. A. Gumerov, and L. S. Davis (2005). "High order spatial audio capture and its binaural head-tracked playback over headphones with HRTF cues", Proc. AES 119th Conv., New York, N.Y., preprint #6540). For perceptual accuracy, the HRTF of the listener must be used.

There exist other recently published methods for capturing and reproducing spatial audio scenes. One of them is Motion-Tracked Binaural Sound (MTB) (see V. Algazi, R. O. Duda, and D. M. Thompson (2004). "Motion-tracked binaural sound", Proc. AES 116th Conv., Berlin, Germany, preprint #6015), where a number of microphones are mounted on the equator of the approximately head-sized sphere and the left and right channels of the headphones worn by user are "connected" to the microphone signals, interpolating between adjacent positions as necessary, based on the current head tracking data. The MTB system successfully creates the impression of presence and responds properly to user motion. Individual HRTFs are not incorporated, and sounds rendered are limited to the equatorial plane only. Another capture and reproduction approach is Wave Field Synthesis (WFS) (see A. J. Berkhout, D. de Vries, and P. Vogel (1993). "Acoustic control by wave field synthesis", J. Acoust. Soc. Am., vol. 93, no. 5, pp. 2764-2778; and H. Teutsch, S. Spors, W. Herbordt, W. Kellermann, and R. Rabenstein (2003). "An integrated real-time system for immersive audio applications", Proc. IEEE WASPAA 2003, New Paltz, N.Y., October 2003, pp. 67-70). In WFS, a sound field incident to a "transmitting" area is captured at the boundary of that area and is fed to an array of loudspeakers arranged similarly on the boundary of a "receiving" area, creating the field in the "receiving" area equivalent to that in the "transmitting area. This technique is very powerful, primarily because it can reproduce the field in the large area, enabling the user to wander off the reproduction "sweet spot"; however, proper field sampling requires extremely large number of microphones/speakers, and most implementations focus on sources that lie approximately in a horizontal plane.

We present the results of a recent research project for portable auditory scene capture and reproduction, where a compact 32-channel microphone array with direct digital interface to the computer via standard USB 2.0 port was developed. We have also developed a software package to support the data capture from the array and scene reproduction with individualized HRTF and head-tracking. The developed system is omnidirectional and supports arbitrary wavefield reproduction (e.g., with elevated or overhead sources). We describe the theory and the algorithms behind the developed hardware and software, the design of the array, the experimental results obtained, and the capabilities and limitations of the array.

C. Background

In this section, we describe the basic theory and introduce notation used in the rest of the paper.

C.1. Acoustic Field Representation

Any regular acoustic field in a volume is subject to Helmholtz equation $$\nabla^2\psi(k,r)+k^2\psi(k,r)=0, \tag{1}$$

where k is the wavenumber, r is a radius-vector of a point within a volume, and $\psi(k, r)$ is an acoustic potential (Fourier transform of the pressure). In a region with no acoustic sources, the regular spherical basis functions $R_n^m(k, r)$ for the Helmholtz equation are given by $$R_n^m(k,r)=j_n(kr)Y_n^m(\theta,\phi), \tag{2}$$

where (r, θ, ϕ) are the spherical coordinates of r, $j_n(kr)$ is the spherical Bessel function of the first kind of order n, and $Y_n^m(\theta,\phi)$ are the spherical harmonics. Any regular acoustic field can be decomposed near the point r* over $R_n^m(k,r)$ as $$\psi(k, r) = \sum_{n=0}^{\infty} \sum_{m=-n}^{n} C_n^m(k) R_n^m(k, r - r^*), \tag{3}$$

where $C_n^m(k)$ are complex coefficients. The infinite summation is truncated at $(p+1)^2$ terms introducing an error $\epsilon(p, k, r, r^*)$:

$$\psi(k, r) = \sum_{n=0}^{p} \sum_{m=-n}^{n} C_n^m(k) R_n^m(k, r - r^*) + \varepsilon(p, k, r, r^*). \tag{4}$$

The parameter p is commonly called the truncation number. It is shown (see N. A. Gumerov and R. Duraiswami (2005). "Fast multipole methods for the Helmholtz equation in three dimensions", Elsevier, The Netherlands) that if $|r-r^*|<D$ then setting $$p = \frac{ekD - 1}{2} \tag{5}$$

results in negligible error term. More accurate estimation of p is possible (see N. A. Gumerov and R. Duraiswami (2005). "Fast multipole methods for the Helmholtz equation in three dimensions", Elsevier, The Netherlands) based on error tolerance.

C.2. Spherical Scattering

The potential $\tilde{\psi}$ (k,s',s) created at a specific point s' on the surface of the rigid sphere of radius a by a plane wave $e^{ikr\cdot s}$ propagating in the direction s is given by (see R. O. Duda and W. L. Martens (1998). "Range dependence of the response of a spherical head model", J. Acoust. Soc. Am., vol. 104, no. 5, pp. 3048-3058)

$$\tilde{\psi}(k, s', s) = \frac{i}{(ka)^2} \sum_{n=0}^{\infty} \frac{i^n (2n+1) P_n(s \cdot s')}{h_n'(ka)}, \tag{6}$$

where $P_n(s\cdot s')$ is the Legendre polynomial of degree n and $h'_n(ka)$ is the derivative of the spherical Hankel function. Note that some authors take s to be the wave arrival direction instead of propagation direction, in which case the equation is modified slightly. In more general case of an arbitrary incident field given by equation (3), the potential $\tilde{\psi}$ (k, s') at point s' is given by $$\tilde{\psi}(k, s') = \frac{i}{(ka)^2} \sum_{n=0}^{\infty} \sum_{m=-n}^{n} \frac{C_n^m(k) Y_n^m(s')}{h_n'(ka)}. \tag{7}$$

Equation (6) can actually be obtained from equation (7) by using Gegenbauer expansion of a plane wave (see M. Abramowitz and I. Stegun (1964). "Handbook of mathematical functions", Government Printing Office) and spherical harmonics addition theorem. Both series can be truncated at p given by equation (5) with D=a with negligible accuracy loss.

C.3. Spatial Audio Perception

Humans derive information about the direction of sound arrival from the cues introduced by sound scattering off the listener's anatomical parts, primarily the pinnae, head, and torso (see W. M. Hartmann (1999). "How we localize sound", Physics Today, November 1999, pp. 24-29). Because of asymmetrical shape of pinna, head shadowing, and torso reflections, the spectrum of the sound reaching the ear canal for distant sources depends on the direction from which the acoustic wave is arriving. A transfer function characterizing those changes is called the head-related transfer function. It is defined as the ratio of potential at the left (right) eardrum $\psi_L(k, \theta, \phi)$ ($\psi_R(k, \theta, \phi)$) to the potential at the center of the head $\psi_C(k)$ as if the listener were not present as a function of source direction (θ, ϕ):

$$H_L(k, \theta, \varphi) = \frac{\psi_L(k, \theta, \varphi)}{\psi_C(k)}, \quad H_R(k, \theta, \varphi) = \frac{\psi_R(k, \theta, \varphi)}{\psi_C(k)}. \tag{8}$$

Here the weak dependence on source range is neglected. The HRTF is often taken to be the transfer function between the center of the head and the entrance to the blocked ear canal. The HRTF constructed or measured according to this definition does not include ear canal effects. It follows that a perception of a sound arriving from the direction (θ, ϕ) can be evoked if the sound source signal is filtered with HRTF for that direction and delivered to the ear canal entrances (e.g., via headphones).

Due to inter-personal differences in body parts sizes and shapes, the HRTF is substantially different for different individuals. Therefore, an HRTF-based virtual audio reproduction system should be custom-tailored for every particular listener. Various methods have been proposed in literature for performing such tailoring, including measuring HRTF directly by placing a microphone in the listener's ear and playing test signals from many directions in space, selecting HRTF from the HRTF database based on pinna features and shoulder dimensions, fine-tuning HRTF for the particular user based on where he/she perceives acoustic signals with different spectra, and others. Recently, a fast method for HRTF measurement was proposed and implemented (see D. N. Zotkin, R. Duraiswami, E. Grassi, and N. A. Gumerov (2006). "Fast head-related transfer function measurement via reciprocity", J. Acoust. Soc. Am., vol. 120, no. 4, pp. 2202-2215), cutting time necessary for direct HRTF measurement from hours to a minute. In the rest of the paper, we assume that the HRTF of a listener is known. If that is not the case, a generic (e.g. KEMAR) HRTF can be used, although one can expect degradation in reproduction accuracy (see E. M. Wenzel, M. Arruda, D. J. Kistler, and F. L. Wightman (1993). "Localization using non-individualized head-related transfer functions", J. Acoust. Soc. Am., vol, 94, no. 1, pp. 111-123).

D. Spatial Scene Recording and Playback

In summary, the following steps are involved in capturing and reproducing the acoustic scene:

- Record the scene with the spherical microphone array;
- Decompose the scene into components arriving from various directions;
- Dynamically render those components for the listener as coming from their respective directions.

As a result of this process, the listener would be presented with the same spatial arrangement of the acoustic energy (including sources and reverberation) as there it was in the original sound scene. Note that it is not necessary to model reverberation at all with this technique; it is captured and played back as part of the spatial sound field.

Below we describe these steps in greater details.

D.1. Scene Recording

To record the scene, the array is placed at the point where the recording is to be made and the raw digital acoustic data from 32 microphones is streamed to the PC over USB cable. In our system, no signal processing is performed at this step and data is stored on the hard disk in raw form.

D.2. Scene Decomposition

The goal of this step is to decompose the scene into the components that arrive from various directions. Several de-composition methods can be conceived, including spherical harmonics based beamforming (see J. Meyer and G. Elko (2002). "A highly scalable spherical microphone array based on an orthonormal de-composition of the soundfield", Proc. IEEE ICASSP 2002, Orlando, Fla., vol. 2, pp. 1781-1784), field decomposition over plane-wave basis (see R. Duraiswami, Z. Li, D. N. Zotkin, E. Grassi, and N. A. Gumerov (2005). "Plane-wave decomposition analysis for the spherical microphone arrays", Proc. IEEE WASPAA 2005, New Paltz, N.Y., October 2005, pp. 150-153), and analysis based on spherical convolution (see B. Rafaely (2004). "Plane-wave decomposition of the sound field on a sphere by spherical convolution", J. Acoust. Soc. Am., vol. 116, no. 4, pp. 2149-2157). While all methods can be related to each other theoretically, it is not clear which of these methods is practically "best" with respect to the ability to isolate sources, noise and reverberation tolerance, numerical stability, and ultimate perceptual quality of the rendered scene. We are currently undertaking a study comparing the performance of those methods using real data collected from the array as well as simulated data. For the described system, we implemented spherical harmonic based beamforming algorithm originally described in (see J. Meyer and G. Elko (2002). "A highly scalable spherical microphone array based on an orthonormal de-composition of the soundfield", Proc. IEEE ICASSP 2002, Orlando, Fla., vol. 2, pp. 1781-1784) and improved (see, e.g., B. Rafaely (2005). "Analysis and design of spherical microphone arrays", IEEE Trans. Speech and Audio Proc., vol. 13, no. 1, pp. 135-143; and H. Teutsch and W. Kellermann (2006). "Acoustic source detection and localization based on wavefield decomposition using circular microphone arrays", J. Acoust. Soc. Am., vol. 120, no. 5, pp. 2724-2736; and Z. Li and R. Duraiswami (2007). "Flexible and optimal design of spherical microphone arrays for beam-forming", IEEE Trans. Speech, Audio, and Language Proc., vol. 15, no. 2, pp. 702-714).

To perform beamforming, the raw audio data is detrended and is broken into frames. The processing is then done on a frame-by-frame basis, and overlap-and-add technique is used to avoid artifacts arising on frame boundaries. The frame is Fourier transformed; the field potential $\psi(k,s'_i)$ at microphone number i is then just the Fourier transform coefficient at wavenumber k. Assume that the total number of microphones is $L_i$ and the total number of beamforming directions is $L_j$. The weights $\omega(k, s_j, s'_i)$ that should be assigned to each microphone to achieve a regular beampattern of order p for the look direction $s_j$ are (see J. Meyer and G. Elko (2002). "A highly scalable spherical microphone array based on an orthonormal de-composition of the soundfield", Proc. IEEE ICASSP 2002, Orlando, Fla., vol. 2, pp. 1781-1784)

$$\omega(k, s_j, s'_i) = \sum_{n=0}^{p} \frac{1}{2i^n b_n(ka)} \sum_{m=-n}^{n} Y_n^{m*}(s_j) Y_n^m(s'_i), \tag{9}$$

$$b_n(ka) = j_n(ka) - \frac{j'_n(ka)}{h'_n(ka)} h_n(ka) \tag{10}$$

and quadrature coefficients are assumed to be unity (which is the case for our system as the microphones are arranged on the truncated icosahedron grid). As noted by many authors, the magnitude of $b_n(ka)$ decays rapidly for n greater than ka, leading to numerical instabilities (i.e., white noise amplification). Therefore, in practical implementation the truncation number should be varied with the wavenumber. In our implementation, we choose $p=\lceil ka \rceil$. Equation (5) can also be used with D=a.

The maximum frequency supported by the array are limited by spatial aliasing; in fact, if $L_i$ microphones are distributed evenly over the sphere of radius a, then the distance between microphones is approximately $4aL_i^{-1/2}$ (a slight underestimate) and spatial aliasing occurs at $k>(\pi/4\ a)\sqrt{L_i}$. Accordingly, the maximum value of ka is about $(\pi/4)\sqrt{L_i}$ and is independent of the sphere radius. Therefore, one can roughly estimate maximum beamforming order p achievable without distorting the beamforming pattern as $p\sim\sqrt{L_i}$, which is consistent with results presented earlier by other authors. This is also consistent with estimation of number of microphones necessary for forming quadrature of order p over the sphere given (see R. Duraiswami, Z. Li, D. N. Zotkin, E. Grassi, and N. A. Gumerov (2005). "Plane-wave decomposition analysis for the spherical microphone arrays", Proc. IEEE WASPAA 2005, New Paltz, N.Y., October 2005, pp. 150-153) as $L_i=(p+1)^2$.

From these derivations, we estimate that with 32 microphones p=5 order should be achievable at higher end of useful frequency range. It is important to understand that these performance bounds are not hard in a sense that the processing algorithms do not break down completely and immediately when constraints on k and on p are violated; rather, these values signify soft limits, and the beampattern start to degrade gradually when those are crossed. Therefore, the constraints derived should be considered approximate and are useful for rough estimate of array capabilities only. We show experimental confirmation of these bounds in the later section.

Figure 8:
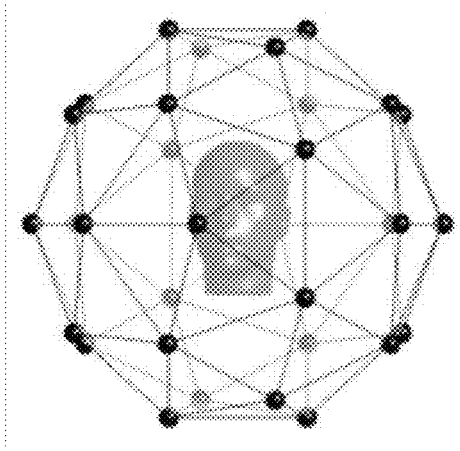
FIG. 8 shows the 32-node beamforming grid used in the system. Each node represents one of the beamforming directions as well as virtual loudspeaker location during rendering.

An important practical question is how to choose the beamforming grid (how large $L_j$ should be and what should be the directions $s'_j$). Obviously the beamformer resolution is finite and is decreasing as p decreases; therefore, it does not make sense to beamform at a grid finer than the beamformer resolution. The angular width of the beampattern main lobe is approximately $2\pi/p$ (see B. Rafaely (2004). "Plane-wave decomposition of the sound field on a sphere by spherical convolution", J. Acoust. Soc. Am., vol. 116, no. 4, pp. 2149-2157), so the width at half-maximum is approximately half of that, or $\pi/p$. At the same time, note that if $p^2$ microphones are distributed evenly over the sphere, the angular distance between neighboring microphones is also $\pi/p$. Thus, with the given number of microphones on the sphere the best beampattern that can be achieved has the width at half-maximum roughly equal to the angular distance between microphones. This is confirmed by experimental data (shown later in the paper). Based on that, we select the beamforming grid to be identical to the microphone grid; thus, from 32 signals recorded at microphones, we compute 32 beamformed signals in 32 directions coinciding with microphone directions (i.e., vectors from the sphere center to the microphone positions on the sphere). FIG. 8 shows the beamforming grid relative to the listener.

Note that the beamforming can be done very efficiently assuming the microphone positions and the beamforming directions are known. The frequency-domain output signal $y_j(k)$ for direction $s_j$ is simply $$y_j(k) = \sum_i \omega(k, s_j, s_i')\psi(k, s_i'), \tag{11}$$

where weights can be computed in advance using equation (9), and time-domain signal is obtained by doing inverse Fourier transform. It is interesting to note that other scene decomposition methods (e.g., fitting-based plane-wave decomposition) can be formulated in exactly the same framework but use weights that are computed differently.

D.3. Playback

After the beamforming step is done, $L_j$ acoustic streams $y_j(k)$ are obtained, each representing what would be heard if a directional microphone were pointed at the corresponding direction. These streams can be rendered using traditional virtual audio techniques (see, e.g., D. N. Zotkin, R. Duraiswami, and L. S. Davis (2004). "Rendering localized spatial audio in a virtual auditory space", IEEE Trans. Multimedia, vol. 6, no. 4, pp. 553-564) as follows.

Assume that the user is placed at the origin of the virtual environment and is free to move and/or rotate; user's motion are tracked by a hardware device, such as Polhemus tracker. Place $L_j$ virtual loudspeakers in the environment far away (say at range of 2 meters). During the rendering, for the current data frame, determine (using the head-tracking data) the current direction $(\theta_j, \phi_j)$ to the $j^{th}$ virtual loudspeaker in user-bound coordinate frame and retrieve or generate the pair of HRTFs $H_L(k, \theta_j, \phi_j)$ and $H_R(k, \theta_j, \phi_j)$ that would be most appropriate to render the source located in direction $(\theta_j, \phi_j)$. This can be a pair of HRTFs for the direction closest to $(\theta_j, \phi_j)$ available in the measurement grid or HRTF generated on the fly using some interpolation method. Repeat that for all virtual loudspeakers and generate total output stream for the left ear $x_L(t)$ as $$x_L(t) = IFFT\left(\sum_j y_j(k)H_L(k, \theta_j, \varphi_j)\right)(t), \tag{12}$$

and similarly for the right ear $x_R(t)$. Note that for online implementation equations (11) and (12) can be combined in a straightforward manner and simplified to go directly (in one matrix-vector multiplication) from time-domain signals acquired from individual microphones to time-domain signals to be delivered to listener's ears.

If a permanent playback installation is possible, the playback can also be performed via a set of 32 physical loud speakers fixed in the proper directions in accordance with the beamformer grid with the user being located at the center of the listening area. In this case, neither head-tracking nor HRTF filtering is necessary because sources are physically external with respect to the user and are fixed in the environment. In this way, our designed spherical array and beamforming package can be used to create virtual auditory reality via loudspeakers, similarly to the way it is done in high-order Ambisonics or in wave field synthesis (see Z. Li and R. Duraiswami (2006). "Headphone-based reproduction of 3D auditory scenes captured by spher-ical/hemispherical microphone arrays", Proc. IEEE ICASSP 2006, Toulouse, France, vol. 5, pp. 337-340; and J. Daniel. R. Nicol, and S. Moreau (2003). "Further investigation of high order Ambisonics and wavefield synthesis for holophonic sound imaging", Proc. AES 114th Conv., Amsterdam, The Netherlands, preprint #5788).

E. Hardware Design

The motivation for the array design was our dissatisfaction with some aspects of our previously developed arrays (see R. Duraiswami, D. N. Zotkin, Z. Li, E. Grassi, N. A. Gumerov, and L. S. Davis (2005). "High order spatial audio capture and its binaural head-tracked playback over headphones with HRTF cues", Proc. AES 119th Conv., New York, N.Y., preprint #6540; and Z. Li and R. Duraiswami (2005). "Hemispherical microphone arrays for sound capture and beamforming", Proc. IEEE WASPAA 2005, New Paltz, N.Y., pp. 106-109). They both had 64 channel and had 64 cables—one per each microphone—that had to be plugged into two bulky 32-channel preamplifiers, which were connected in turn to two data acquisition cards in a desktop PC. Street scenes recording was complicated due to the need to bring all the equipment out and keep it powered; furthermore, connection cables were coming loose quite often. In addition, occasionally microphones were failing and it was challenging to replace a microphone in a tangle of 64 cables. So in a nutshell the design goal was to have portable solution requiring no external hardware, having microphones easily replaceable, and connecting with one cable instead of 64.

Figure 9:
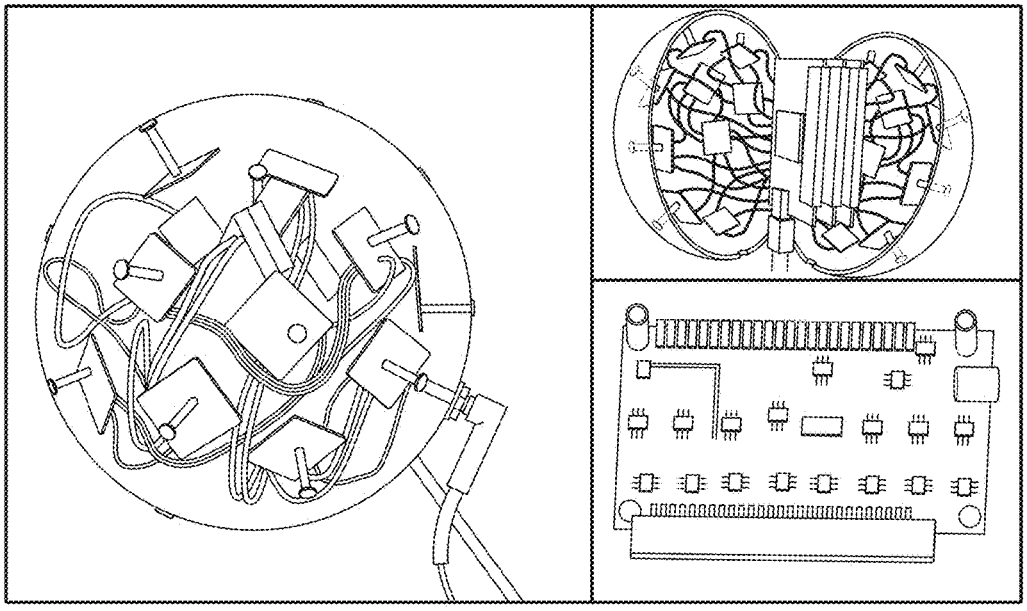
FIG. 9 shows an assembled spherical microphone array at the left; an array pictured open, with a large chip in the middle being the FPGA, at the top right; and a close-up of an ADC board at the bottom right.

The physical support of the new microphone array consists of two polycarbonate clear-color hemispheres of radius 7.4 cm. FIG. 9 shows the array and some of its internal components. 16 holes are drilled in each hemisphere arranging a total of 32 microphones in truncated icosahedron pattern. Panasonic WM-61A speech band microphones are used. Each microphone is mounted on a miniature (2 by 2 cm) printed circuit board; those boards are placed and glued into the spherical shell from the inside so that the microphone appears from the microphone hole flush with the surface. Each miniature circuit board contains an amplifier with a gain of 50 using the TLC-271 chip, a number of resistors and capacitors supporting the amplifier, and two connectors—one for microphone and one for power connection and signal output. A microphone is inserted into the microphone connector through the microphone hole so that it can be pulled out and replaced easily without disassembling the array.

Three credit-card sized boards are stacked and placed in the center of the array. Two of these boards are identical; each of these contains 16 digital low-pass filters (TLC-14 chips) and one 16-channel sequential analog-to-digital converter (AD-7490 chip). The digital filter chip has programmable cutoff frequency and is intended to prevent aliasing. ADC accuracy is 12 bits.

The third board is an Opal Kelly XEM3001 USB interface kit based on Xilinx Spartan-3 FPGA. The USB cable connects to the USB connector on XEM3001 board. There is also a power connector on the array to supply power to the ADC boards and to amplifiers. All boards in the system use surface-mount technology. We have developed custom firmware that generates system clocks, controls ADC chips and digital filters, collects the sampled data from two ADC chips in parallel, buffers them in FIFO queue, and sends the data over USB to the PC. Because of the sequential sampling nature, phase correction is implemented in beamforming algorithm to account for skew in channel sampling times. PC side acquisition software is based on FrontPanel library provided by Opal Kelly. It simply streams the data from the FPGA and saves it to the hard disk in raw form.

In the current implementation, the total sampling frequency is 1.25 MHz, resulting in the per-channel sampling frequency of 39.0625 kHz. Each data sample consists of 12 bits with 4 auxiliary "marker" bits attached; these 4 bits can potentially be stripped on FPGA to reduce data transfer rate. Even without that, the data rate is about 2.5 MBytes per second, which is significantly below the maximum USB 2.0 bandwidth. The cut-off frequency of the digital filters is set to 16 kHz. However, these frequencies can be changed easily in software, if necessary. Our implementation also consumes very little of available FPGA processing power. In future, we plan to implement parts of signal processing on the FPGA as well; modules performing FIR/IIR filtering, Fourier transform, multiply-and-add operations, and other basic signal processing blocks are readily available for FPGA. Ideally, the output of the array can be dependent on the application (e.g., in an application requiring visualization of spatial acoustic patterns the firmware computing spatial distribution of energy can be downloaded and the array could send images showing the energy distribution, such as plots presented in the later section of this paper, to the PC).

The dynamic range of 12-bit ADC is 72 dB. We had set the gain of the amplifiers so that the signal level of about 90 dB would result in saturation of ADC, so the absolute noise floor of the system is about 18 dB. Per specification, the microphone signal-to-noise ratio is more than 62 dB. In practice, we observed that in a recording done in a silence in soundproof room the self-noise of the system spans the lowest 2 bits of the ADC range. Useful dynamic range of the system is then about 60 dB, from 30 dB to 90 dB.

The beamforming and playback are implemented as separate applications. Beamforming application processes the raw data, forms 32 beamforming signals using the described algorithms, and stores those on disk in intermediate format. Playback application renders the signals from their appropriate directions, responding to the data sent by head-tracking device (currently supported are Polhemus FasTrak, Ascension Technology Flock of Birds, and Intersense InertiaCube) and allowing for import of individual HRTF for use in rendering. According to preliminary experiments, combined beamforming and playback from raw data can be done in real time; this is being currently implemented.

F. Results and Limitations

Figure 10:
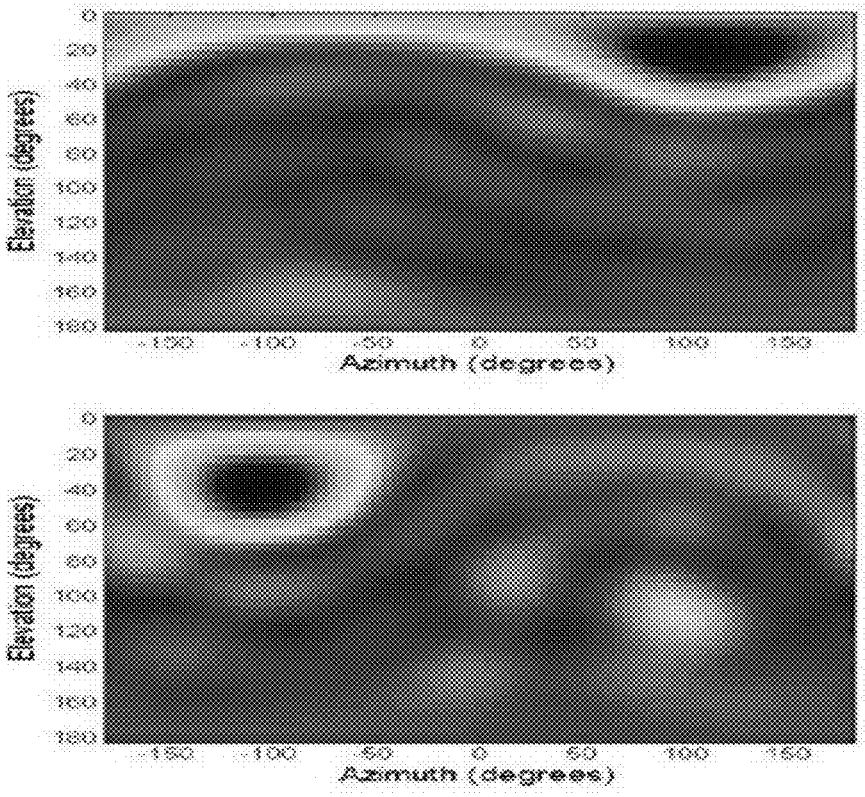
FIG. 10 shows the steered beamformer response power for speaker 1 (top plot) and speaker 2 (bottom plot). Clear peaks can be seen in each of these intensity images at the location of each speaker.

To test the capabilities of our system, we performed a series of experiments in which recordings were made containing multiple sound sources. During these experiments, the microphone array was suspended from the ceiling in a large reverberant environment (a basketball gym) at approximately 1 meter above the ground, and conversations taking place between two persons standing each about 1.5 meters from the array were recorded. Speaker one ($S_1$) was located at approximately (20, 140) degrees (elevation, azimuth) and speaker two ($S_2$) was located at (40, −110). We plotted first the steered beamformer response power at the frequency of 2500 Hz over the whole range of directions (FIG. 10). The data recorded was segmented into fragments containing only a single speaker. Each segment was then broken into 1024-sample long frames, and the steered power response was computed for each frame and averaged over the entire segment. FIG. 10 presents the resulting power response for $S_1$ and $S_2$. As can be seen, the maximum in the intensity map is located very close to the true speaker location.

Figure 11:
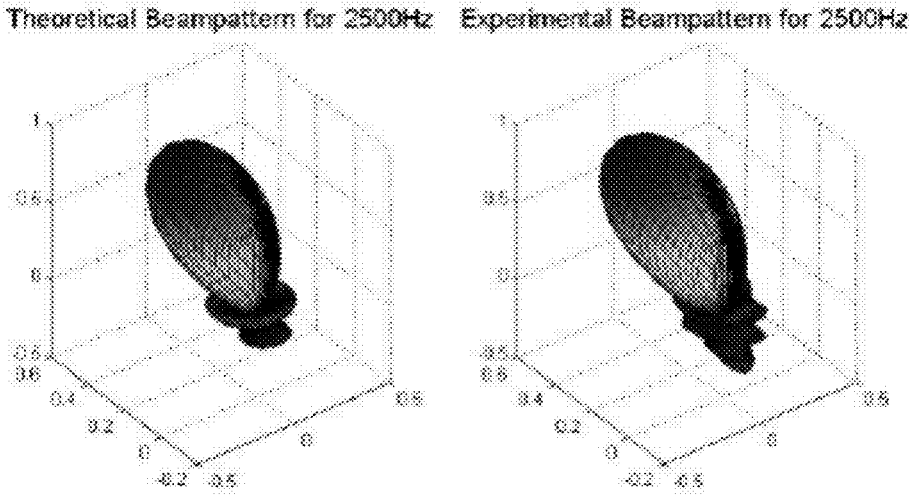
FIG. 11 shows a comparison of the theoretical beampattern for 2500 Hz and the actual obtained beampattern at 2500 Hz. Overall the achieved beampattern agrees quite well with theory, with some irregularities in side lobes.

In plots in FIG. 10, one can actually see the "ridges" surrounding the main peak waving throughout the plots as well as the "bright spot" located opposite to the main peak. In FIG. 11, we re-plotted the steered response power in three dimensions to visualize the beampattern realized by our system in reverberant environment and compared this experimentally-generated beampattern (FIG. 11, left) with the theoretical one (FIG. 11, right) at the same frequency of 2500 Hz (at that frequency, p=4). It can be seen that the plots are substantially similar. Subtle differences in the side lobe structure can be seen and are due to the environmental noise and reverberation; however the overall structure of the beam is faithfully retained.

Figure 12:
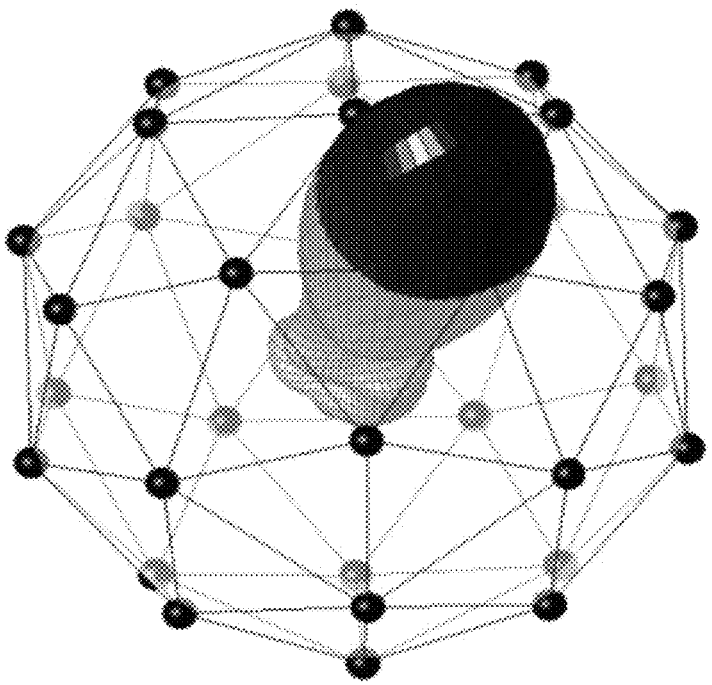
FIG. 12 shows beampattern overlaid with the beamformer grid (which is identical to the microphone grid).

Another plot that provides insights to the behavior of the system is presented in FIG. 12. It was predicted in section 3.2 that the beampattern width at half-maximum should be comparable to the angular distance between microphones in the microphone array grid; in this plot, the beampattern is actually overlaid with the beamformer grid (which is in our case the same as the microphone grid). It is seen that this relationship holds well and it indeed does not make much sense to beamform at more directions than the number of microphones in the array.

Figure 13:
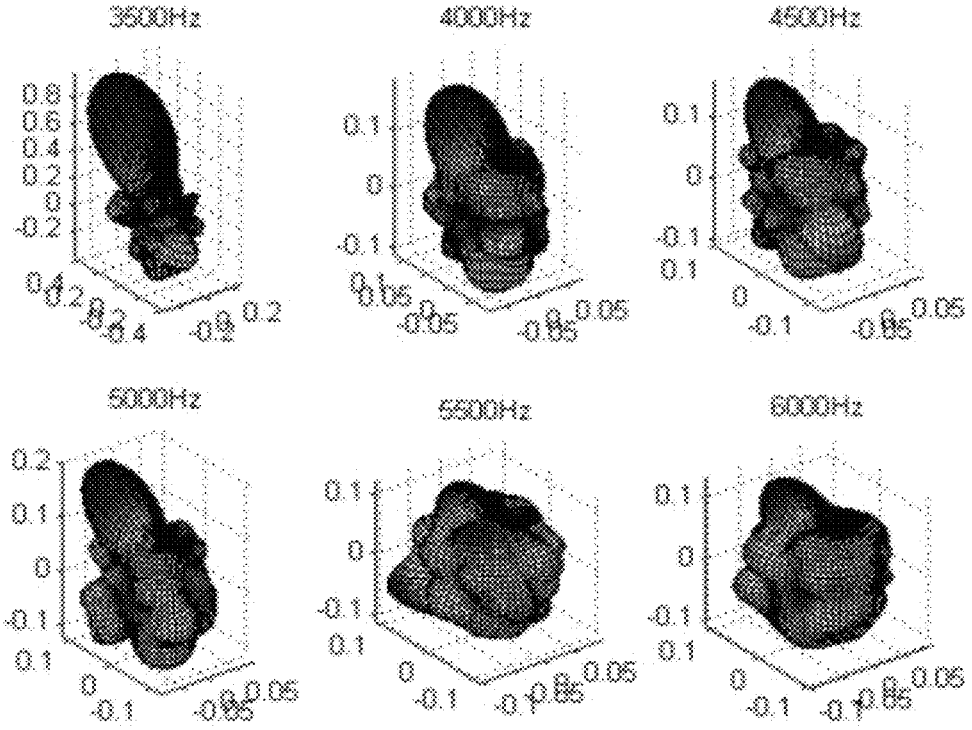
FIG. 13 shows the effect of spatial aliasing. Shown from top left to bottom right are the obtained beampatterns for frequencies above the spatial aliasing frequency. As one can see, the beampattern degradation is gradual and the directionality is totally lost only at 5500 Hz.

Using experimental data, we also looked at the beampattern shape at frequencies higher than the spatial aliasing limit. Using derivations in section 3.2, we estimate the spatial aliasing frequency to be approximately 2900 Hz. In FIG. 13, we show the experimental beamforming pattern for frequencies higher than this limit for the same data fragment as in the top panel of FIG. 10. As FIG. 13 shows, beyond the spatial aliasing frequency spurious secondary peaks begin to appear, and at about 5500 Hz they surpass the main lobe in intensity. It is important to notice that these spatial aliasing effects are gradual. According to these plots, we can estimate "soft" upper useful array frequency to be about 4000 Hz.

Figure 14:
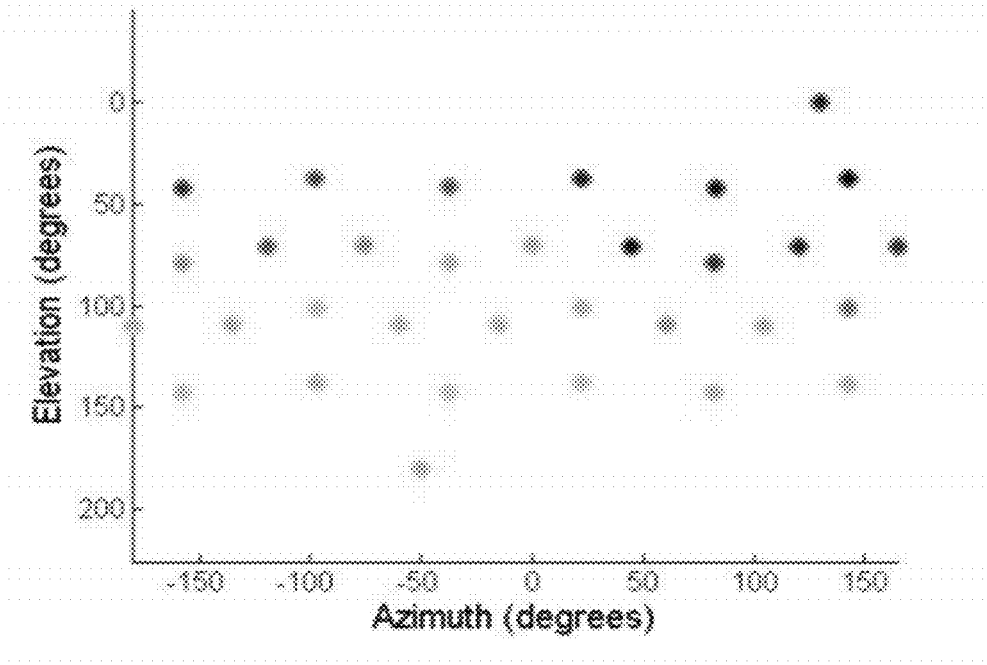
FIG. 14 shows cumulative power in [5 kHz, 15 kHz] frequency range in raw microphone signal plotted at the microphone positions as the dot color. A peak is present at the speaker's true location.
Figure 15:
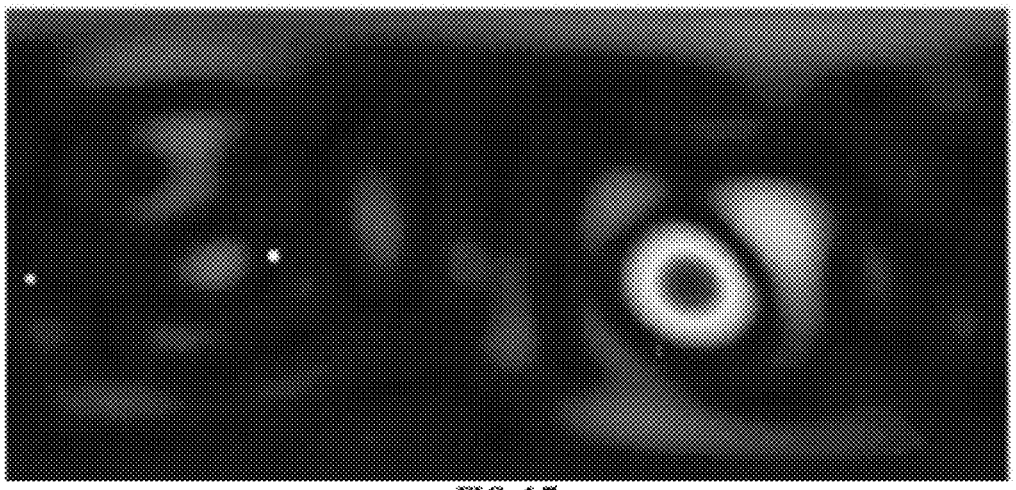
FIG. 15 shows a sound image created by beamforming along a set of 8192 directions (a 128×64 grid in azimuth and elevation), and quantizing the steered response power according to a color map.

To account for this limitation, we implement a fix for properly rendering higher frequencies similarly to how it is done in MTB system (see V. Algazi, R. O. Duda, and D. M. Thompson (2004). "Motion-tracked binaural sound", Proc. AES 116th Conv., Berlin, Germany, preprint #6015). For a given beamforming direction, we perform beamforming only up to the spatial aliasing limit or slightly above. We then find the closest microphone to this beamforming direction and high pass filter the actual signal recorded at the microphone using the same cut off frequency. The two signals are then combined to form a complete broadband audio signal. The rationale for that decision is that at higher frequencies the effects of acoustic shadowing from the solid spherical housing are significant, so the signal at microphone located at direction s' should contain mostly the energy for the source(s) located in the direction s'. FIG. 14 shows a plot of the average intensity at frequencies from 5 kHz to 15 kHz for the same data fragment as in the top panel of FIG. 10. As can be seen, a fair amount of directionality is present and the peak is located at the location of the actual speaker.

Informal listening experiments show that it is generally possible to identify locations of the sound sources in the rendered environment and to follow them along as they move around. The rendered sources appear stable with respect to the environment (i.e., stay in the same position if the listener turns the head) and externalized with respect to the listener. Without the high-frequency fix, elevation perception is poor because the highest frequency in the beamformed signal is approximately 3.5 kHz and cues creating the perception of elevation are very weak in this range. When high-frequency fix is applied, elevation perception is restored successfully, although the spatial resolution of the system is inevitably limited by the beampattern width (i.e., by the number of microphones in the array). We are currently working on gathering more experimental data with the array and on further evaluating reproduction quality.

G. Conclusions and Future Work

We have developed and implemented a 32-microphone spherical array system for recording and rendering spatial acoustic scenes. The array is portable, does not require any additional hardware to operate, and can be plugged into a USB port on any PC. Spherical harmonics based beamforming and HRTF based playback software was also implemented as a part of complete scene capture and rendering solution. In test recordings, system capabilities agree very well with theoretical constraints. A method for enabling scene rendering at frequencies higher than the array spatial aliasing limit was proposed and implemented. Future work is planned on investigating other plane-wave decomposition methods for the array and on using array-embedded processing power for signal processing tasks.

IV. Imaging Concert Hall Acoustics using Visual and Audio Cameras

A. Abstract

Using a recently developed real time audio camera, that uses the output of a spherical microphone array beamformer steered in all directions to create central projection to create acoustic intensity images, we present a technique to measure the acoustics of rooms and halls. A panoramic mosaiced visual image of the space is also create. Since both the visual and the audio camera images are central projection, registration of the acquired audio and video images can be performed using standard computer vision techniques. We describe the technique, and apply it to the examine the relation between acoustical features and architectural details of the Dekelbaum concert hall at the Clarice Smith Performing Arts Center in College Park, Md.

B. Introduction

Human listening enjoyment and our ability to localize sound and identify environments are greatly influenced (both positively and negatively) by the process of the source sound scattering. Scattering off the environment and off the human before it reaches the ear-canal for physiological transduction and scene interpretation allows for scene interpretation and source localization. The scattering off the listening space (such as an office space, concert hall, classroom, etc.) is influenced by its geometry and the materials of the walls and other scatterers in the space. Since the time of the early acousticians (see, e.g., W. C. Sabine (1900). "Reverberation", originally published in 1900 and reprinted in Acoustics: Historical and Philosophical Development, ed. by R. Lindsay. Dowden, 1972), numerous studies on how reverberation affects human perception of sound and music have been conducted. Since the reverberation properties of a room play extremely important role in determining the listening experience (see, e.g., H. Kuttruff. *Room acoustics* ($3^{rd}$ edition), Elseiver, 1991), architectural acousticians use design principles and measurements/simulation to assure that the room acoustics helps the perception of the performance rather than ruining it.

Room acoustics is generally evaluated in terms of various subjective characteristics expert musicians/listeners assign to sound received at a location in space such as liveness, intimacy, fullness/clarity, warmth/brilliance, texture, blend, and ensemble. Most of these criteria are related to the room impulse response between the sound sources (usually on stage, or from speakers distributed in the hall) and receiver locations (the two ears of the listener at a particular seat). The impulse response is in turn characterized by the direct path from the source to the receiver(s) and the scattered sound received at the received locations. The structure and the discreteness of the early reflections, the directions they arrive from (within about the first 80 ms of first arrival as discussed in D. R. Begault (1994). 3*D sound for virtual reality and multimedia*, Academic Press Professional, Boston, Mass.) and the overall energy and structure and directionality of the later part of the response are all held responsible for the various listening characteristics of a space (see M. Barron and A. H. Marshall, "Spatial impression due to early lateral reflections in concert halls: the derivation of physical measure," J. Sound Vib., 77:211-232 1981.). Modern listening spaces have various computer controlled reflecting elements (curtains, screens, reflectors), that can be placed to provide some control of the achieved nature of the impulse response.

In general the experimental characterization of a space is done via measurements of impulse responses, preferably binaural. A study of the impulse response, attributing various elements of it to architectural features, and the modification of the space to either eliminate or enhance some of the features of the impulse response, are all part and parcel of the work of an architectural acoustician. Of course, as every concert-goer knows, not all seats in a concert hall are created equal in terms of their listening characteristics, and the impulse response varies significantly as source and receiver locations change.

Spherical microphone arrays provide an opportunity to study the full spatial characteristics of the sound received at a particular location. Over the past few years there have been several publications that deal with the use of spherical microphone arrays (see, e.g., J. Meyer and G. Elko, "A highly scalable spherical microphone array based on an orthonormal decomposition of the soundfield," Proc. ICASSP, 2:1781-1784, 2002; and Z. Li, R. Duraiswami, E. Grassi and L. S. Davis, "Flexible layout and optimal cancellation of the orthonormality error for spherical microphone arrays," ICASSP2004, IV:41-44, 2004; and B. Rafaely, "Analysis and design of spherical microphone arrays," IEEE Trans. Speech Audio Proc., 13, 135-143 2005). Such arrays are seen by some researchers as a means to capture a representation of the sound field in the vicinity of the array (see, e.g., R. Duraiswami et al., "System for capturing of high-order spatial audio using spherical microphone array and binaural head-tracked playback over headphones with HRTF cues," Proc. 119th convention AES, 2005), and by others as a means to digitally beamform sound from different directions using the array with a relatively high order beampattern (see, e.g., Z. Li and R. Duraiswami. "Flexible and Optimal Design of Spherical Microphone Arrays for Beamforming," IEEE Trans. Audio, Speech and Lang. Proc., 15:702-714, 2007).

Audio Cameras for Characterizing Room Acoustics:

A particularly exciting use of these arrays is to steer it to various directions and create an intensity map of the acoustic power in various frequency bands via beamforming. The resulting image, since it is linked with direction, can be used to relate sources with physical objects and scatterers (image sources) in the world and identify sources of sound and be used in several applications, including the imaging of concert hall acoustics that we discuss in this paper.

Such spherical camera images have already been used to preliminarily characterize concert hall responses (see, e.g., M. Park and B. Rafaely. Sound-field analysis by plane-wave decomposition using spherical microphone array. J. Acoust. Soc. Am., 118:3094-4003, 2005), though in that paper the measurements were performed over extended periods of time, and the identification with physical objects was performed by interpretation. In effect we use our spherical array and its ability to generate images in real-time as an audio camera. For precision and automation the sound images must be captured in conjunction with a visual camera, and the two must be automatically analyzed to determine correspondence and identification of visual features and the acoustics of the space. For this a formulation for the geometrically correct warping of the two images, taken from an array and cameras at different locations is necessary. We use such a formulation, first presented in a previous paper (see Adam O'Donovan, Ramani Duraiswami, Jan Neumann. "Microphone Arrays as Generalized Cameras for Integrated Audio Visual Processing." Proc. IEEE CVPR. 1:1-8, 2007) that enables the use of a common geometry for analyzing visual and auditory images.

Paper Outline:

In Sec. 2 we provide some background and notation for spherical arrays. In Sec. 3 we briefly describe the joint analysis of audio and visual images. In Sec. 4 we describe our measurements of the Dekelbaum theater, and discuss the measurements. Sec. 5 concludes the paper.

C. Spherical Microphone Array Audio Imaging

Beamforming with Spherical Microphone Arrays:

Let sound be captured at N microphones at locations $\Theta_s=(\theta_s, \phi_s)$ on the surface of a solid spherical array. To beamform the signal in direction $\Theta=(\theta,\phi)$ at frequency f (corresponding to wavenumber $k=2\pi f/c$, where c is the sound speed), we sum up the temporal Fourier transform of the pressure at the different microphones, $d_s^k$ as $$\psi(\Theta; k) = \sum_{s=1}^{S} \omega_N(\Theta, \Theta_s, ka) d_s^k(\Theta_s). \tag{1}$$

The weights $\omega_N$ are related to the quadrature weights $C_n^m$ for the locations $\{\Theta\}$, and the $b_n$ coefficients obtained from the scattering solution of a plane wave off a solid sphere $$\omega_N(\Theta, \Theta_s, ka) = \sum_{n=0}^{N} \frac{1}{2i^n b_n(ka)} \sum_{m=-n}^{n} Y_n^{m*}(\Theta) Y_n^m(\Theta_s) C_n^m(\Theta_s). \tag{2}$$

For the placement of microphones at special quadrature points, a set of unity quadrature weights $C_n^m$ are achieved. In practice, it was observed (see Z. Li and R. Duraiswami. "Flexible and Optimal Design of Spherical Microphone Arrays for Beamforming," IEEE Trans. Audio, Speech and Lang. Proc., 15:702-714, 2007) that for $\{\Theta\}$ at the so-called Fliege points, higher order beampatterns were achieved with some noise (approaching that achievable by interpolation $(N+1)=\sqrt{S}$). In the beamformer used in this paper, we use one order lower than this limit, the Fliege microphone locations, and beamforming to a fixed $\Theta$ grid of audio image pixel locations. This allows taking advantage of the spherical harmonic addition theorem which states that $$P_n(\cos\gamma) = \frac{4\pi}{2n+1} \sum_{m=-n}^{n} Y_n^{-m}(\Theta) Y_n^m(\Theta_s) \tag{3}$$

where $\Theta$ is the spherical coordinate of the audio pixel and $\Theta_s$, is the location of the sth microphone, $\gamma$ is the angle between these two locations and $P_n$ is the Legendre polynomial of order n. This observation reduces the order $n^2$ sum in Eq. (2) to an order n sum. The image generation can be performed at a high frame rate using processing on a graphical processing unit (see Adam O'Donovan, Ramani Duraiswami, Nail A. Gumerov, "Real Time Capture of Audio Images and Their Use with Video," accepted, to appear Proc. IEEE WASPAA, 2007).

D. Combining Audio and Visual Cameras

Figure 16:
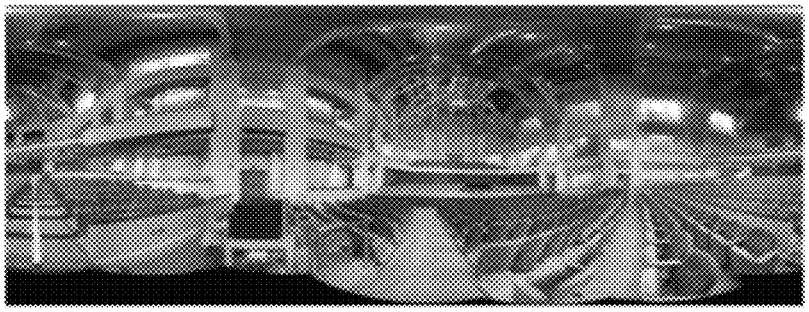
FIG. 16 shows a spherical panoramic image mosaic of the Dekelbaum Concert Hall of the Clarice Smith Center at the University of Maryland.

Spherical Panorama of the Dekelbaum Theater:

As discussed above the spherical array provides a spherical image of the intensities of planewaves from all directions. We needed to compute a similar visual spherical image of the space being measured. To do this, we took a regular digital camera, which we calibrated using standard computer vision procedures. Using this camera we took several overlapping pictures of the theater from near the locations where audio measurements were to be made. While the procedures for creating a panoramic mosaic are well described in the computer vision literature, we simply used a free version of ptGui, a panoramic toolbox available at http://www.ptgui.com/. It finds correspondences in the images automatically and stitches them into a $(\theta, \phi)$ omnidirectional spherical image (FIG. 16).

Joint Audio-Visual Processing and Calibration:

In a previous paper (see Adam O'Donovan, Ramani Duraiswami, Jan Neumann. "Microphone Arrays as Generalized Cameras for Integrated Audio Visual Processing." Proc. IEEE CVPR. 1:1-8, 2007) we provide a detailed outline of how to use cameras and spherical arrays together and determine the geometric locations of a source. The key observation was that the intensity image at different frequencies created via beamforming using a spherical array could be treated as a central projection (CP) camera, since the intensity at each "pixel" is associated with a ray (or its spherical harmonic reconstruction to a certain order). When two CP cameras observe a scene, they share an "epipolar geometry" (see R. Hartley and A. Zisserman. Multiple View Geometry in Computer Vision. Cambridge University Press, 2000). Given two cameras and several correspondences, it is possible to take points in one cameras coordinate system and relate them to directly to pixels in the second cameras coordinate system. Given a single spherical panoramic image and a corresponding audio panorama image, the transfer can be accomplished if we assume that the world is on the surface of a far sphere. Further cameras can make this transfer without this assumption, but we did not pursue this here.

E. Acoustical Analysis of a Concert Hall

Measurements:

We performed several experiments at the Dekelbaum concert hall located at our university. We created the image panorama at two different locations, one close to the stage and one towards the center of the hall, at the lower level. The spherical array was placed near where the locations where the panorama was built. For calibration between the visual and audio images, sounds were generated near prominent features in the visual image and the transformation between the audio and the visual panoramic images obtained. All our measurements can be viewed as a 3D movie that can be navigated at www.umiacs.umd.edu/~odonovan/Visual_Reverb.htm.

Next, a loudspeaker source was placed at center-stage and a chirp of length 10 ms played from it. The received data was collected at the microphone array and ten repetitions were taken. We allowed a waiting time of 5 s between measurements, to allow reverberations to die out. The Dekelbaum theater has computer controlled settings which allows various reflective and absorptive elements, at the windows, near the ceiling, and at the back of the hall to be spread out to achieve a "normal" and a "reverberant" setting (other settings are also available). The readings were taken in each of these two settings.

Results of the Measurements:

Since these measurements were of a somewhat preliminary nature, aimed at both convincing ourselves and others that joint audio-visual imaging can be used to reveal the acoustical features of a listening space, we will present a few observations that our measurements allowed us to make These results are presented as images in which the acoustic camera image is warped on to the spherical panoramic image, using alpha-blending, with the value of the alpha blending parameter proportional to the peak. A greyscale colormap is used for the acoustical image, and the peak of this colormap is adjusted at each frame. Each individual image then displays the peaks in the sound at that time.

Figure 18:
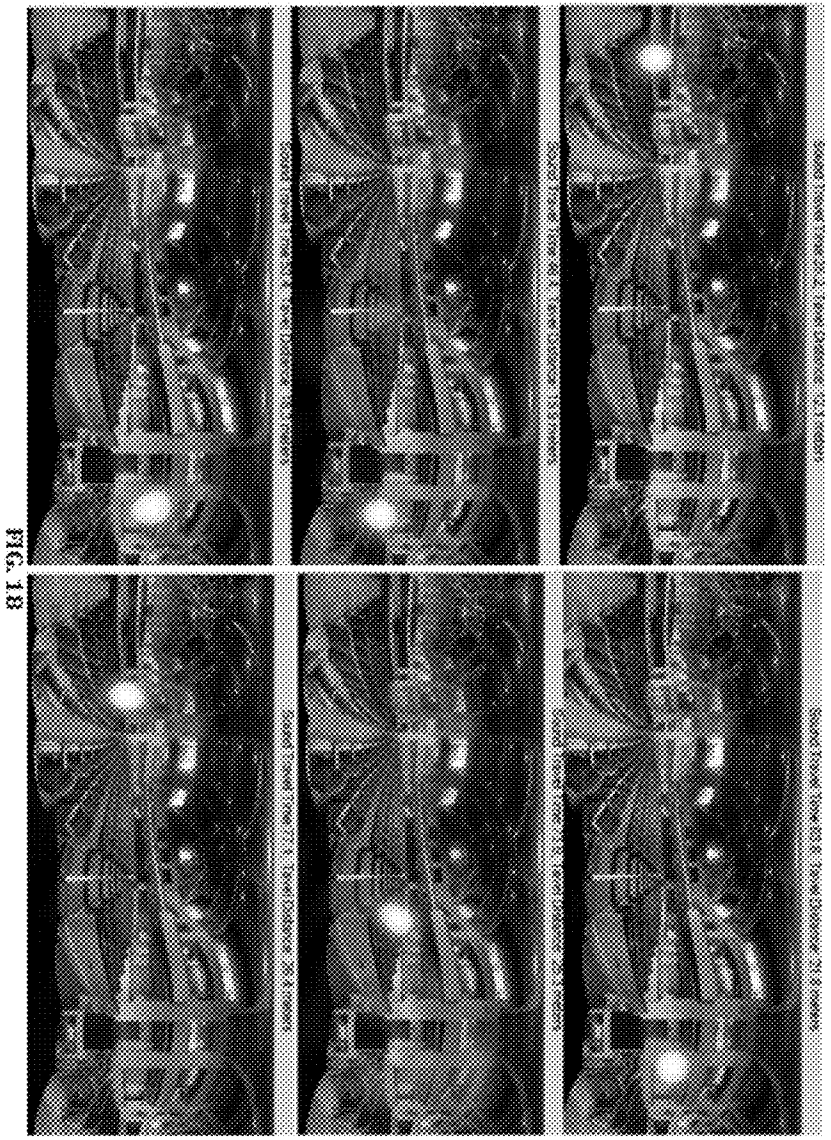
FIG. 18 shows the frame corresponding to the arrival of the source sound at the array located at the center of the hall, followed by the first five reflections. The sound images are warped on to the spherical panoramic mosaic and display the geometrical/architectural features that caused them.

Identifying Particular Contributions to the Impulse Response:

During the first 90 ms of the recording the acoustic energy highly localized in the images These very distinct peaks correspond initially to first order reflections. The first major reflection which appears as a single peak in FIG. 18 occurring at 45-60 ms is actually a combination of 3 sequential reflections from the front face of the closest lower balcony and the join of the upper balcony and a support column. In the acoustic video the peak can be seen starting at the front face of the lower balcony sliding up the support column and remaining at the front face of the upper balcony for 5 ms. Approximately 4-5 ms later (1-2 m of sound travel time) the third components of this initial reflection can be seen originating at the back wall of the lower balcony which is consistent with the balconies depth. The next major peak, occurring from 80-90 ms, occurs on the wall directly across the concert hall and exhibits similar behavior starting first at the lower balcony and then sliding up to the second balcony front. After this point the acoustic energy becomes more diffuse and is distributed in several peaks.

Figure 19:
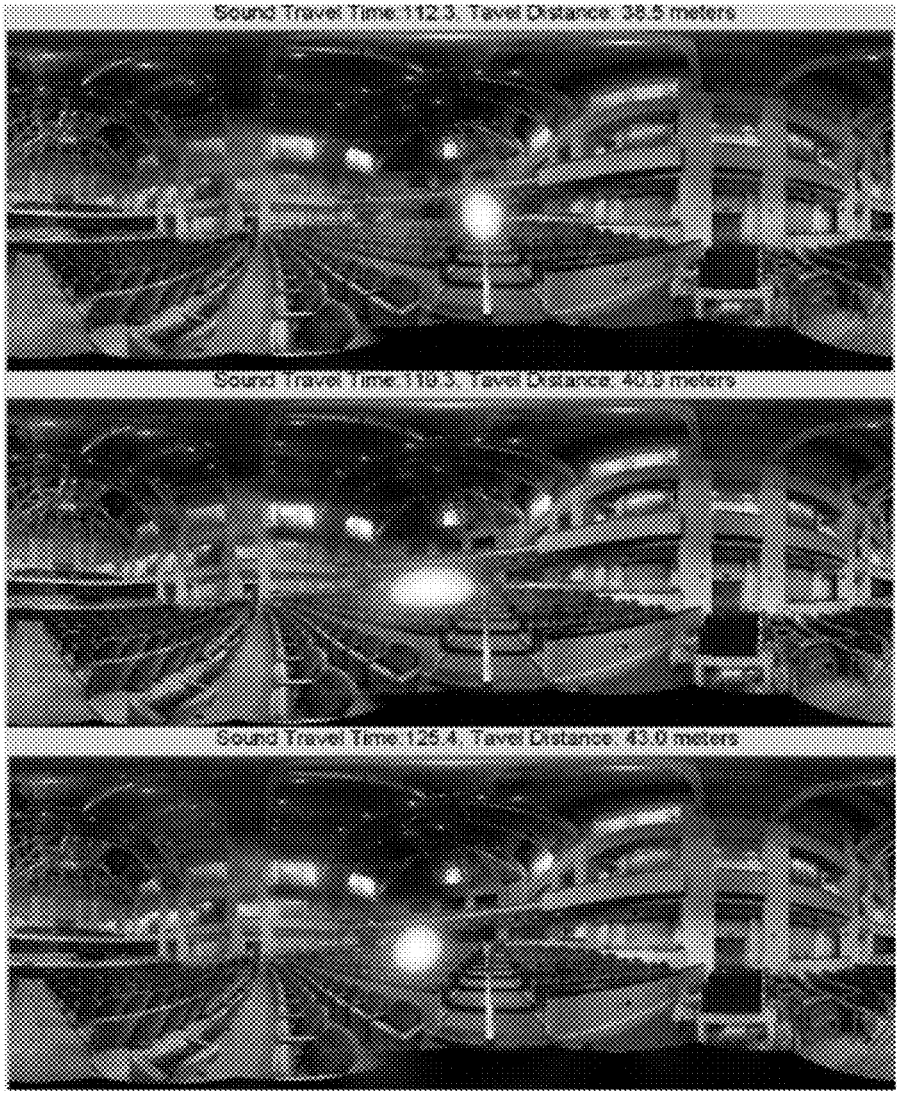
FIG. 19 shows that in the intermediate stage the sound appears to focus back from a region below the balcony of the hall to the listening space, and a bright spot is seen for a long time in this region.

Middle Time Response:

From 100-150 ms a very strong peak can be seen in FIG. 19. This peak is associated with a focusing effect of the concave back balcony and lower back wall. The peaks can be seen dancing from left to right and peaking in the center of the wall.

Figure 20:
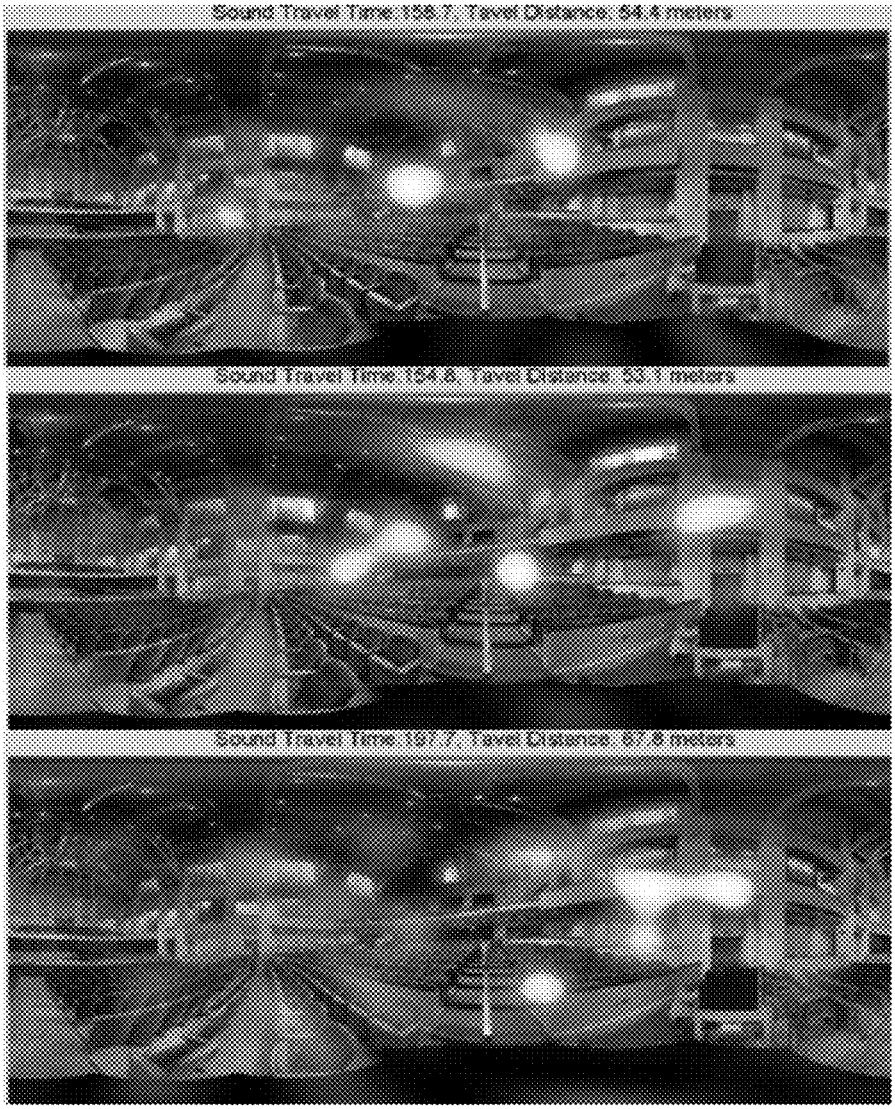
FIG. 20 shows in the later stages, the hall response is characterized by multiple reflections, and "resonances" in the booths on the sides of the hall.

Late Time Response:

Beyond this time, the response is dominated by various pockets of resonant energy in open cavities formed by balconies and box seat areas. FIG. 20 shows a number of these effects.

Figure 17:
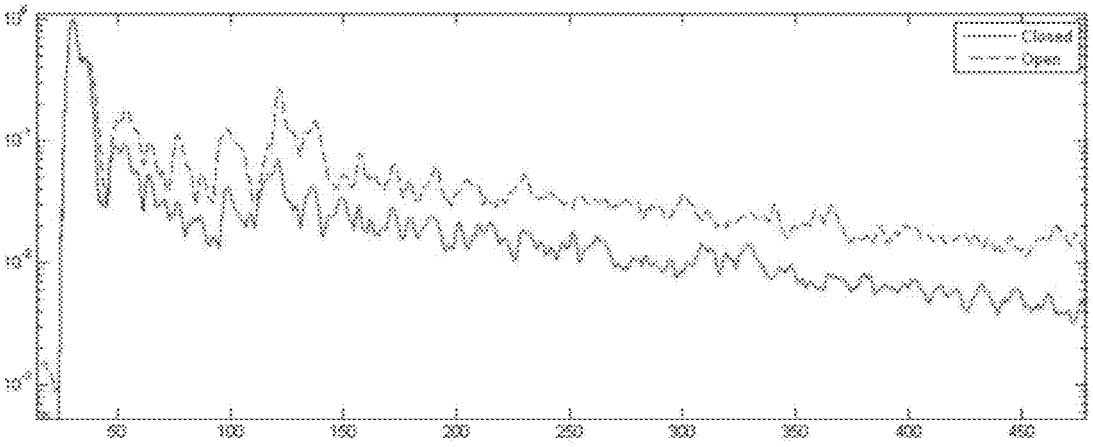
FIG. 17 shows peak beamformed signal magnitude for each sample time for the case the hall is in normal mode, and it is in reverberant mode. Each audio image at the particular frame is normalized by this value.

Measurements in the Reverberant Condition:

In the reverberant condition, with all of the acoustic curtains drawn up, the structure of the first 150 ms is very similar to the damped case. The energy however, is much stronger in each of the reflections. After 150 ms, the energy in the hall remains much higher with all of the acoustic curtains drawn up but the structure of the peaks begins to change showing stronger effects resonances occurring at the balconies and the back comers of the ceiling. FIG. 17 shows a plot of the decay in energy from the initial direct sound intensity in both of the conditions.

Focusing Effects:

The focusing effects observed above are much stronger in the resonant condition, and the acoustical energy dances around the region beneath the balcony.

G. Conclusions

While the various mechanisms by which sound waves interact with structures are well understood, the acoustics of a listening space such as a concert hall is a complex mixture of these interactions. The spherical array based audio camera can be an extremely useful tool to study the acoustics, and manipulate and understand this acoustics. In conjunction with visual cameras we can make precise identification of the causes of various interactions. As mentioned the audio system is capable of real-time operation. Real-time visual panoramic mosaic generators (e.g., from PointGrey Research and Immersive Media) are also available, and can be combined with our real-time spherical audio image generator to achieve a straightforward implementation that can allow for the interactive imaging and understanding of the acoustics of spaces. Measurements of several others spaces are planned in the near future, as are collaborations with room acousticians.

What is claimed is:

1. A method comprising:

providing at least one processing unit comprising a plane-wave decomposing section and a playback section;

receiving, at the plane-wave decomposing section, audio data generated via an array of microphones, the audio data representing an acoustic scene;

performing plane-wave field decomposition on the audio data to decompose the audio data into a plurality of signals representing audio components of the acoustic scene arriving from a plurality of directions, using the plane-wave decomposing section; and rendering the audio components for a listener based on the plurality of directions of the audio components, using the playback section, wherein the step of rendering the audio components includes retrieving or generating at least one head-related transfer function for each of the plurality of directions, rendering the audio component arriving from each of the plurality of directions using a respective retrieved or generated head-related transfer function, and combining the rendered audio components to generate a total output stream.

2. The method of claim 1, wherein the head-related transfer function is a head-related transfer function that is not specific to the listener.

3. The method of claim 1, wherein the head-related transfer function is a head-related transfer function that is specific to the listener.

4. The method of claim 1 wherein the step of rendering is performed dynamically by incorporating real-time data about movement of a head of a listener during the step of rendering.

5. The method of claim 1, wherein the step of rendering is performed using a grid of speakers arranged in a geometric pattern corresponding to a geometric pattern of the array of microphones.

6. The method of claim 1, wherein the microphones of the array of microphones are integrated into a single portable device.

7. The method of claim 1, wherein the step of performing plane-wave field decomposition is performed in real time with the generation of the audio data via the array of microphones.

8. The method of claim 1, wherein the step of rendering is performed after the step of performing plane-wave field decomposition completes.

9. The method of claim 1, wherein the step of rendering is performed immediately following the step of performing plane-wave field decomposition.

10. The method of claim 1, wherein the received audio data is audio data that was previously recorded by the array of microphones.

11. The method of claim 1, wherein the step of performing plane-wave field decomposition is performed using beamforming.

12. The method of claim 10, wherein the beamforming is performed based on a grid of beamforming directions and wherein the grid of beamforming directions is identical to a grid representing a geometric pattern of the array of microphones.

13. The method of claim 10, wherein the audio data is separated around a spatial aliasing limit, the beamforming is performed separately on the separated audio data, and the separate audio data is then recombined after beamforming.

14. The method of claim 1, wherein the step of performing plane-wave field decomposition is performed using analysis based on spherical convolution.

15. The method of claim 1, wherein the array of microphones is arranged as a spherical array.

16. A system comprising:

an array of microphones configured to generate audio data from an acoustic scene; and at least one processing unit comprising a plane-wave decomposing section and a playback section, the at least one processing unit being configured to:

receive, at the plane-wave decomposing section, the audio data generated via the array of microphones, perform plane-wave field decomposition on the audio data to decompose the audio data into a plurality of signals representing components of the acoustic scene arriving from a plurality of directions, using the plane-wave decomposing section, and render the audio components for a listener based on the plurality of directions of the audio components, using the playback section, wherein the rendering of the audio components includes retrieving or generating at least one head-related transfer function for each of the plurality of directions, rendering the audio component arriving from each of the plurality of directions using a respective retrieved or generated head-related transfer function, and combining the rendered audio components to generate a total output stream.

17. The system of claim 16, further comprising:

a motion tracking unit configured to generate head position data by monitoring movement of a head of the listener and provide the head position data to the at least one processing unit; and an audio presentation device configured to present the rendered audio components to the listener, wherein the processing unit is further configured to:

render the audio components using the head position data, and transmit the rendered audio components to the audio presentation unit.

18. A non-transient computer readable medium encoded with a computer program, the computer program being configured to:

receive, at a plane wave decomposing section, audio data generated via an array of microphones, the audio data representing an acoustic scene;

performing plane-wave decomposition on the audio data using the decomposing section to decompose the audio data into a plurality of signals representing components of the acoustic scene arriving from a plurality of directions; and render, using a playback section, the audio components for a listener based on the plurality of directions of the audio components wherein the rendering of the audio components includes retrieving or generating at least one head-related transfer function for each of the plurality of directions, rendering the audio component arriving from each of the plurality of directions using a respective retrieved or generated head-related transfer function, and combining the rendered audio components to generate a total output stream.

* * * * *